US009901959B2

(12) United States Patent
Kucala

(10) Patent No.: US 9,901,959 B2
(45) Date of Patent: Feb. 27, 2018

(54) SYSTEM AND TOOLS FOR REMOVING STRONGLY ADHERED FOREIGN MATTER FROM A WORK SURFACE

(71) Applicant: John T. Kucala, Mokena, IL (US)

(72) Inventor: John T. Kucala, Mokena, IL (US)

( * ) Notice: Subject to any disclaimer, the term of this patent is extended or adjusted under 35 U.S.C. 154(b) by 77 days.

(21) Appl. No.: 15/009,811

(22) Filed: Jan. 28, 2016

(65) Prior Publication Data

US 2017/0189939 A1 Jul. 6, 2017

Related U.S. Application Data

(60) Provisional application No. 62/108,842, filed on Jan. 28, 2015.

(51) Int. Cl.

| | |
|---|---|
| ***B24B 53/00*** | (2006.01) |
| ***B08B 1/00*** | (2006.01) |
| ***B08B 3/04*** | (2006.01) |

(52) U.S. Cl.

CPC ..... *B08B 1/006* (2013.01); *B08B 3/04* (2013.01); *B24B 53/00* (2013.01)

(58) Field of Classification Search

CPC ..... B60S 3/04; B60S 3/3044; B60S 3/3045; B08B 1/00; B08B 1/001; B08B 1/006; A47L 13/16; A47L 13/17; A47L 13/28

USPC .... 15/104, 93, 94, 244.1, 244.4, 208, 209.1, 15/223, 224, 229.11, 230, 230.16

See application file for complete search history.

(56) References Cited

U.S. PATENT DOCUMENTS

| | | | | | |
|---|---|---|---|---|---|
| 3,021,649 | A | * | 2/1962 | Robbins | B24D 15/04 15/118 |
| 3,611,468 | A | * | 10/1971 | Michael | A47L 13/16 15/104.93 |
| 4,111,666 | A | * | 9/1978 | Kalbow | A47L 13/16 15/118 |
| 4,130,683 | A | * | 12/1978 | Michel | A47L 13/16 15/229.11 |
| 4,512,859 | A | | 4/1985 | Inoue | |
| 4,738,887 | A | * | 4/1988 | Govertsen | A63C 11/08 15/104.93 |
| 5,476,416 | A | | 12/1995 | Kodate | |
| 5,676,714 | A | | 10/1997 | Kodate | |
| 5,727,993 | A | | 3/1998 | Kodate | |

(Continued)

FOREIGN PATENT DOCUMENTS

| | | |
|---|---|---|
| JP | 1-97572 | 10/1987 |
| JP | 4-11335 | 2/1992 |

*Primary Examiner* — George Nguyen

(74) *Attorney, Agent, or Firm* — Mark D. Weis Law, P.C.; Mark D. Weis

(57) ABSTRACT

An elastically deformable compressible polishing material having a functional and repeating pattern of lowered reservoirs and raised plateaus on the elastically deformable compressible polishing material, and a tool and method for making a functional and repeating pattern of lowered reservoirs and raised plateaus on an elastically deformable compressible polishing material and a method and system for removing strongly adhered foreign matter from a work surface, such that an operator can both measure and control polishing force and identify when to clean and/or discard the elastically deformable compressible polishing material, thus reducing costs, waste and operator fatigue while maximizing overall performance and value of the polishing operation.

46 Claims, 10 Drawing Sheets

(56) References Cited

U.S. PATENT DOCUMENTS 5,778,481 A * 7/1998 Amsden ..... B08B 1/04 15/102
5,822,826 A * 10/1998 Parker ..... B44D 3/00 15/210.5
5,904,758 A 5/1999 Kucala, III
5,928,064 A 7/1999 Miller
6,206,759 B1 * 3/2001 Agarwal ..... B24B 37/22 451/307
6,241,579 B1 6/2001 Miller
7,094,449 B2 8/2006 Bouler, Jr.
7,169,029 B2 * 1/2007 Petersen ..... B24D 15/04 451/523
D553,932 S 10/2007 Boler, Jr.
7,867,967 B2 1/2011 Tsai
8,025,557 B2 9/2011 Andrichik
8,430,724 B2 4/2013 Heilian
8,992,644 B2 * 3/2015 Kodate ..... B24D 3/28 51/298
2001/0039175 A1 * 11/2001 Golzarian ..... B24B 37/26 451/526
2001/0041529 A1 * 11/2001 Tintelnot ..... A47L 13/16 451/526
2003/0094186 A1 * 5/2003 Klein ..... A47L 17/08 134/6
2005/0107011 A1 * 5/2005 Welygan ..... B24D 3/002 451/41
2007/0293130 A1 * 12/2007 Miekka ..... B24D 3/346 451/526
2008/0233845 A1 * 9/2008 Annen ..... B24D 9/08 451/259
2008/0318506 A1 * 12/2008 Brown ..... B24D 11/00 451/539
2009/0038101 A1 * 2/2009 Duda ..... A47L 13/16 15/229.11
2009/0178223 A1 * 7/2009 Martin Rivera ..... A47L 13/16 15/229.11
2011/0159786 A1 * 6/2011 Joseph ..... B24B 37/042 451/36
2012/0100783 A1 * 4/2012 Itoyama ..... B24B 37/24 451/36
2012/0227203 A1 * 9/2012 Ouellette ..... B32B 5/022 15/209.1
2014/0261538 A1 * 9/2014 Elseri ..... A46B 9/005 134/6
2015/0327745 A1 * 11/2015 MacHii ..... A47L 13/16 15/209.1

* cited by examiner

SYSTEM AND TOOLS FOR REMOVING STRONGLY ADHERED FOREIGN MATTER FROM A WORK SURFACE

This application claims the benefit of provisional patent application No. 62/108,842, filed Jan. 28, 2015 which is incorporated by reference herein in its entirety.

BACKGROUND

The present invention relates to the cleaning and smoothing of surfaces having strongly adhered foreign matter. More specifically, the present invention relates to a product and method of forming a functional and repeating pattern of reservoirs and raised plateaus formed on an elastically deformable compressible polishing material, and a method of removing strongly adhered foreign matter from a work surface and a method for the operator to both measure and control polishing force, reduce operator fatigue, lower costs and maximize efficiency and performance of the polishing operation.

A multitude of contaminants and strongly adhered foreign matter affect coated and uncoated surfaces and cause a diminished appearance and breakdown of protective layers and/or coatings, thereby creating costly repairs and diminished value of the item with the coated surface. There are many types of foreign matter which can affect coated and non-coated surfaces, including but not limited to paint overspray, iron mist, brake dust, tree sap, bug residue, industrial fallout, and many other type of pollutants and foreign matter that can settle onto a work surface and are not easily washed from the surface using a detergent solution. Conventional methods of removing such contaminants from coated and non-coated surfaces include the use of water, detergents, polishes and abrasives in a variety of forms. Conventional products and methods of removing such strongly adhered foreign matter consist of a broad range of products that can be costly, environmentally unfriendly, confusing to operate, time consuming and laborious for the operator and in many cases cause more damage to the work surface and cause increased cost of repairs.

In the field of cleaning, polishing and/or removing contaminants and/or strongly adhered foreign matter from work surfaces, there is a voluminous variety of compositions, tools, systems and methods. In particular, U.S. Pat. No. 4,512,859 by Inoue and examined published Japanese Patent Application 1-97572 by Furudate and JPB411335 disclose both elastic and plastic compositions and methods for polishing and/or cleaning work surfaces of contaminants and/or strongly adhered foreign matter both with and without holders and/or applicators. JPB0197572 by Furudate discloses a holder in the form of a foam pad for the plastic flexible grinding stone. Over the years many improvements and innovations have been made in this field. A multitude of patents relate to various polishing compositions, methods and systems including but not limited to; U.S. Pat. No. 4,512,859 by Inoue, JPB0197572 by Furudate, U.S. Pat. No. 5,476,416 by Kodate, U.S. Pat. No. 5,727,993 by Kodate, U.S. Pat. No. 5,904,758 by Kucala, U.S. Pat. No. 5,928,064 by Miller, U.S. Pat. No. 5,676,714 by Kodate, U.S. Pat. No. 6,241,579 by Miller, U.S. Pat. No. 7,094,449 by Boler. U.S. Pat. No. 7,867,967 by Tsai, U.S. Pat. No. 8,025,557 by Andrichik and U.S. Pat. No. 8,430,724 by Heilian. In some manner, all of the aforementioned references disclose plastic and elastic polishing compositions, systems and/or methods of polishing a work surface of an automotive, marine, aviation or other transportation vehicle. Japanese patent JPB0197572 by Furudate, U.S. Pat. No. 5,476,416 by Kodate and U.S. Pat. No. 5,727,993 by Kodate specifically disclose a means of removing strongly adhered foreign matter from a work surface using a plastic flexible tool comprising a plastic flexible material with and/or without detergent as means of both removing strongly adhered foreign matter and a means of controlling polishing force. Many of the compositions formulated according to these related art references require frequent folding or kneading of the polishing material during the polishing operation. However, as such material can harden or dry out over time, this folding or kneading can become difficult if not impossible, thus causing many problems as instructions on the related art products recommend storing moist in an air tight container to keep the material from drying out and becoming useless.

Contaminants that are being polished or removed from the work surface using such conventional products and methods in most cases actually adhere to the surface of the polishing material itself and can blend in with the polishing material and/or are not easily noticed by the operator. As such, there is no definitive way for the operator to determine if turning, folding or kneading and/or cleaning of the material is required or when the material should be discarded. Moreover, if there are no contaminants on the surface of the polishing material itself, and the operator is unnecessarily turning, folding and/or kneading the polishing material, this causes unnecessary work, increased labor costs, project delays and operator fatigue. In many situations, such compositions and methods of the conventional means are used to remove paint overspray. In the automotive repair industry, there is a type of paint coating which is transparent or "clear." As this type of coating is used in workshops and near vehicles, frequently "overspray" can be deposited and adhere to vehicle surfaces and cause a diminished appearance and reduced gloss reflectivity thus requiring cleaning, polishing and removal of such transparent paint overspray. The surface of a vehicle is cleaned and/or polished using such conventional products and methods of the related art. This type of contamination is normally not visible on the surface of the vehicle, however can be located conventionally by feeling the work surface with the human hand. However, such transparent contamination sometimes cannot be seen on the surface of the polishing materials. As such, often times the polishing operation using the conventional methods is not efficient or cost effective. Often times, polishing materials that contain this type of transparent contamination are not used to their full ability and/or are discarded unnecessarily. While a composition and method is disclosed in U.S. Pat. No. 5,676,714 by Kodate in an attempt to address the frequent turning, folding and/or kneading of the polishing materials, with "rotatable globular particles," there has been no composition or method or variation thereof which has ever been reduced to actual practice or commercialized and the clogging phenomenon as it is referenced in the U.S. Pat. No. 5,676,714 by Kodate patent is still an issue of concern with these types of related art materials. U.S. Pat. No. 5,928,064 by Miller and U.S. Pat. No. 6,241,579 by Miller disclose compositions systems and methods of locating contamination on the surface of automotive finishes or work surface to be polished and also reference the polishing material as claimed in the U.S. Pat. No. 5,676,714 by Kodate patent. However, again, no such material has ever been reduced to actual practice or commercialized. U.S. Pat. No. 7,094,449 by Boler discloses an improvement on the related art compositions disclosed in the U.S. Pat. No. 5,476,416 by Kodate and U.S. Pat. No. 5,727,993 by Kodate. The U.S. Pat. No. 7,094,449 by Boler discloses combining the related art materials with a surface coating composition while also impregnating said material into a foam pad type applicator system to both remove contamination and apply a surface coating to the work surface being polished. U.S. Pat. No. 7,867,967 by Tsai discloses a composition consisting of a colloid material (25%-60%), resin (10%-20%), abrasive powders (15-30%), stabilizer, fibers and natural turpentine that are bonded together to form said cleaning mixture composition. This U.S. Pat. No. 7,867,967 Tsai patent appears to operate in the same manner to the related art methods and discloses that the claimed composition operates in such a manner to "shovel up" substances and/or contaminants that have adhered to automotive finishes. However, the specification of this '967 Tsai patent discloses that the operation is performed without the use of water or any other component that is not included in the cleaning mixture itself. The specification of the '967 Tsai patent discloses that to "remove superficially adhered substances from a working surface . . . a user only needs to exert the sponge serving to buffer and evenly distribute the force applied thereon, permitting the cleaning surface of the mixture article to precisely correspond to the substances bonded onto the working surface. Part of the adhered substance squeezed by the mixture article will get encapsulated thereby and the different crystalized abrasive powders and carbon powders added to the mixture article can boost the suction power between the mixture article and the working surface so that the mixture article can contact with the adhered substances to generate a shovel like effect and shovel up the adhered substances from the working surface. The, the adhesion property of the colloid material and resin will viscously grip the adhered substances to clean up with working surface and the static electricity generated by the friction on the surface of the colloid material will easily suck up the adhered substances. Thus, without great force exerting therein, the mixture article can wipe off toughly adhered substances and clean them from the working surface in an easy and effortless manner. After the cleaning job is done, the mixture article can be simply washed by water to clean the micro particles adhered thereto so that the mixture article can be repeatedly applied to enhance its durability thereby."

The claim of "resin" in the patent claim, and only more specifically identified in the patent specification as an "ecofriendly nature resin" is added in a proportion of 10% to 20% respectively, and according to the patent specification is added to "provide the mixture article with appropriate adhesion, elasticity and coherence." There is no specific ingredient, trade name or product name or other reference to "resin" listed in the claims or patent specification although there is much discussion about "natural turpentine" in this patent specification. The patent specification discloses that the natural turpentine "can boost the cohesive and adhesive properties of the components thereof to form the mixture article." While there is not a clear distinction between the "resin" and "natural turpentine" it appears that the two components are listed as separate in the claim, yet seem to describe identical purposes and functions in the specification. Similar to the related art U.S. Pat. No. 7,094,449 Boler patent, the '967 Tsai patent also claims that the specific "mixture article" can be mounted to a sponge body fitted to a polishing (waxing) device, thus permitting the polishing (waxing) device to combine with the mixture article into one unit so that "the mixture article can be utilized to achieve polishing and waxing effects." This '967 Tsai patent discloses and claims that the claimed mixture article is "defined by uneven and irregular texture having adhesive gaps formed among the ribs thereof that can also viscously grip and remove fine dust from the working surface in the polishing or waxing process."

U.S. Pat. No. 8,430,724 by Heilian discloses a combination of improvements over the wide variety of related art in this area, although like much of the other related art, this invention has not been reduced to actual practice or commercialized. The specification of the '724 Heilian patent states that "The primary objective of the present invention is that the surface cleaning system can efficiently remove stain, including high adhesive substance, from a surface, especially a surface of an automobile, without damaging the surface. The surface cleaning system comprises a retainer having a non-absorbing retaining surface and a surface cleaning compound retained at the retaining surface of the retainer and formed a cleaning surface overlapped thereat."

Thus, the '724 Heilian patent claims a more precise design over the '967 Tsai patent generally incorporating an "overlapping retainer," the use of water and also more specific and defined "grooves" having a similar function as disclosed in the '967 Tsai patent.

The specification of the '724 Heilian patent discloses a system with a "retainer" utilizing the same cleaning mixture article of the aforementioned '967 Tsai patent and discloses further embodiments for additional applicators and the use of a "solvent" to which the "solvent" can be either natural turpentine or plain water. According to the specification, the additional element of "water" seems to be operational for two functions, as both a means of lowering manufacturing temperature [as opposed to using natural turpentine] and a means of enhancing the operation temperature of the surface cleaning compound during the surface cleaning operation. Accordingly, the secondary element of adding water during the surface cleaning operation was not a requirement or claimed element of the cleaning operation as described in the '967 Tsai patent, and to the contrary it seems as though the '967 Tsai patent taught a functional benefit over the related art because the cleaning operation could be performed only with the cleaning mixture article and without the use of water or other lubricants.

Additionally, the specification of this '724 Heilian patent discloses "a plurality of contaminant collecting grooves is formed at the cleaning surface to collect contaminants being grabbed by the surface cleaning compound in order to prevent the contaminants accumulated by the surface cleaning compound to scratch the working surface."

The related art '967 Tsai patent discloses that the mixture article is "defined by uneven and irregular texture having adhesive gaps formed among the ribs thereof that can also viscously grip and remove fine dust from the working surface in the polishing or waxing process" and "the mixture article can be simply washed by water to clean the micro particles adhered thereto." However, those skilled in the art understand that not all micro particles adhered to the mixture article of the '967 patent by Tsai can be washed away or removed from the mixture article. An operational disadvantage of this mixture article is that contaminants such as paint overspray cannot be removed from this mixture article, and thus the clogging phenomenon of the related art is still a problem of this mixture article of products according to the '967 patent by Tsai.

Accordingly, one could surmise that according to the specification of the '724 Heilian patent, the claimed benefit of adding the "overlapping retainer" is so that water can be introduced to the polishing operation using the cleaning mixture article so that (a) the water is not absorbed into the sponge article, and (b) so that the "micro particles" or "contaminants" that have been removed from the polishing surface and thereby collected into the "grooves" of the cleaning mixture article can be easily rinsed away with water during the polishing operation.

The specification of the '724 Heilian patent and illustrations further define and disclose that "The contaminant collecting grooves are longitudinally and transversely formed on the cleaning surface of the cleaning head, wherein the contaminant collecting grooves are intersected with each other on the cleaning surface of the cleaning head." The ordinary dictionary definition of a "groove" is "a long narrow cut or low area in a surface." This ordinary dictionary definition is the same as the grooves as described and as shown in the illustrations of the '724 Heilian patent. Moreover, this design shares similarity to the design of a "buffing pad" as claimed in U.S. Pat. No. D553,932S by Boler which is by the same inventor as U.S. Pat. No. 7,094,449 by Boler of the aforementioned related art. Interestingly enough U.S. Pat. No. 7,094,449 by Andrichik, U.S. Pat. No. 7,867,967 by Tsai and U.S. Pat. No. 8,430,724 by Heilian all bear striking similarity in function, operation and almost identical disclosures of the specifications and the claims.

While some of the related art plastic flexible tools date back to their first use on automobile surfaces as early as 1987, there is still significant issues reported of associated product and operator failure and errors, of both professional and consumer polishing operations and also reports of damage to the work surfaces and wasted product. Even with the closely related inventors and patents as mentioned above having combined buffing pads with functional designs and also colloidal materials with or without contaminant collecting grooves, there has never been any use, claimed function, benefit or commercialization of any elastically deformable compressible polishing material having a functional and repeating pattern of reservoirs and raised plateaus and a means for an end user and/or operator to efficiently introduce such functional structures into an elastically deformable compressible polishing material.

The related art which claims plastic flexible grinding stones, plastic flexible tools and sanding clay according to their respective specifications contain a makeup comprised of approximately 60% resins and 40% abrasives. Many also claim to have a combination of different resins in a variety of percentages and combinations, varying percentages of solvents, detergents, processing oils, surface coating agents, fillers, fibers, foam particles, extenders and/or other pigments incorporated therein as taught in the art. It is common practice for producers and resellers of this related art plastic flexible polishing materials that the plastic flexible polishing materials are to be first pressed flat against a work surface to form a flat and planar surface of the plastic flexible polishing material prior to the polishing operation. There are many drawbacks to this related art category one of which is their lack of ability to indicate to the operator if the proper working pressure is being applied, accomplished and/or achieved during the polishing operation. This has caused many problems including damage to the surface by both professional and consumer operators. Another drawback is the lack of indication to the operator when the product should be folded, reformed and/or discarded. Another drawback is the lack of the ability to measure and control polishing force without the use of a precise mixture of a plastic flexible material and/or a detergent incorporated within the polishing material itself. Accordingly it can be seen that this related art does not have the benefits and/or claimed combination of features, limitations and elements of the present invention as will be set forth herein.

U.S. Pat. No. 4,512,859 by Inoue claims a broad range and combination of abrasives and resins in polishing and cleaning operations for removing contaminants and strongly adhered foreign matter. The '859 Inoue patent abstract states "A novel method of polishing a work piece surface comprises passing over the surface in elastically compressive abrasive contact therewith a mass of discrete, elastically deformable pieces each individually consisting of a matrix of elastomeric material containing finely divided abrasive particles substantially uniformly distributed at least along a surface region of the individual piece." Moreover, the specification of this '859 Inoue patent discloses that abrasive particles can be in the matrix of elastomeric material within a range from 10% to 80% and the matrix can consist of a variety of substances including synthetic or natural rubber, silicone resin, urethane resin, epoxy resin and a variety of other resins.

The '967 Tsai patent accordingly claims a very specific cleaning mixture which consists of colloid material (25%-60%), resin (10%-20%) and abrasive powders (15%-30%), stabilizer, fibers and natural turpentine. The ordinary dictionary definition of a "colloid" is "A substance in which microscopically dispersed insoluble particles are suspended throughout another substance. Sometimes the dispersed substance alone can be a colloid." When reviewing the definition of colloid, it is referenced that rubber by itself is a colloid. Although, the ordinary definition of colloid discloses that it is an "insoluble particle" it is well known in the art that rubber is mixed with solvents, including turpentine, to help them to be more easily dispersed throughout a mixture. Further, the '967 Tsai patent claims that the colloid material can comprise silicone gel, medical used white glue, and hot melt adhesive. Accordingly, the cleaning composition of the '967 Tsai patent requires the use of natural turpentine which is very hazardous. Natural turpentine is an organic solvent and its vapor can irritate the skin and eyes as well as damage the lungs, respiratory system and central nervous system when inhaled. Natural turpentine can also cause renal failure, among other things, when ingested. Being combustible, natural turpentine also poses a fire hazard. Accordingly because the cleaning composition of the '967 Tsai patent requires the use of this hazardous substance, the drawbacks for the manufacturing, handling and use of this method are quite obvious.

There is also a functional and operational problem with the mixture article of the '967 patent by Tsai such that contaminants such as "paint overspray" form a permanent bond to the mixture article itself and cannot be "washed away or cleaned" in any manner from the mixture article. The related art which also experiences the "clogging phenomenon" however can be folded or kneaded and has an operational advantage over the mixture article of the '967 patent by Tsai. Once the mixture article of the '967 Tsai patent is clogged with paint overspray the mixture article no longer functions and since it cannot be cleaned of the overspray and the surface of the mixture article cannot be renewed, it must be discarded because it is no longer operational. Thus there is a significant functional and operational disadvantage of the mixture article of the '967 patent by Tsai.

Such related art compositions are very dark black or dark grey or other dark color due to the use of carbon black, rubber and/or other ingredients used during the manufacturing process. This specific related art category comprises products which are not only hazardous, they are very costly for the operator with significant operational disadvantages and product problems. One disadvantage of this related art category is that the operator cannot determine if there are any particles adhered to the product that could damage the work surface. Another operational disadvantage is that the operator cannot determine if the proper operational pressure is being achieved during the polishing operation, which is crucial for the variety of polishing objectives and, in many cases, can cause severe damage to automotive painted surfaces requiring significant "paint correction" which is a timely and costly process.

Other significant disadvantages of this particular related art category is that the operator cannot determine when the polishing material should be cleaned, nor when the polishing material has lost its' ability to function properly in a polishing operation. In some situations, a single operator is responsible for conducting a polishing operation and a coating operation. Such related art product causes increased costs and increased labor and operator fatigue. In many situations, an operator will conduct a polishing operation using these type of related art products and methods, and then move on to the coating/waxing process. However, in the coating/waxing process additional contaminants that the related art products and methods have missed are revealed and/or noticed by the operator, and the entire process needs to be repeated and contaminants removed before the coating/waxing process can be achieved properly on a work surface that is free of contaminants and/or strongly adhered foreign matter. Furthermore, in many situations a polishing operation using such related art products is conducted in an assembly line by one operator and then another coating and/or waxing operation is conducted by a different operator further down the assembly line. In many situations like this, the coating and/or waxing operation of the second operator will find contaminants that the first polishing operation missed due to product failure and/or misuse and/or operator failure, disrupting the assembly line, with decreased production rate, increased product costs and labor costs and costly and cumbersome delays.

It would therefore be desirable to provide an elastically deformable compressible polishing material, and a method of removing strongly adhered foreign matter from a work surface to both measure and control polishing force, reduce operator fatigue, lower costs and maximize efficiency and performance of the polishing operation.

SUMMARY

An objective of the present invention is to provide an elastically deformable compressible polishing material having a functional and repeating pattern of reservoirs and raised plateaus. Another objective of the present invention is to provide a system and method for which the operator has the benefit of: (a) indicating and/or measuring if the proper pressure is being applied during the polishing operation by the operator; (b) having the ability for the operator to control the polishing force and/or compressive force during the polishing operation; (c) having the ability to indicate to the operator when the elastically deformable compressible polishing material should be turned, folded, cleaned, reformed or discarded thereby extending the life of the elastically deformable compressible polishing material minimizing user fatigue due to excessively folding, kneading, cleaning or reforming the elastically deformable compressible polishing material and maximizing the surface area of the elastically deformable compressible polishing material that is used; (d) provides the operator with a tool and means of making a functional and repeating pattern of reservoirs and raised plateaus for maximized performance and to realize the full benefit of the present invention; (e) the functional and repeating pattern of reservoirs and raised plateaus in the elastically deformable compressible polishing material aid the operator in folding, kneading and/or reforming the elastically deformable compressible polishing material.

An objective of this invention is to provide an elastically deformable compressible polishing material, system and method comprised of an enhanced elastically deformable compressible polishing material with functional and repeating pattern of reservoirs and raised plateaus and in which the system and method comprise a tool for the operator to place such functional and repeating pattern of reservoirs and raised plateaus into the elastically deformable compressible polishing material during the polishing operation as needed to receive the full benefit of the present invention.

Another objective of the present invention is to provide a more cost effective and simplified polishing operation to reduce time and costs to maximize the polishing objective and operations of removing strongly adhered foreign matter using the elastically deformable compressible polishing material in an extremely effective and environmentally friendly manner.

While there has been a voluminous amount of related art discussed herein, none of the related art discloses and/or claims a combination of the features and/or benefits of the present invention. The combination of tools, limitations, features, elements, functions, systems, methods and/or combination of claimed procedures of the claimed invention are not claimed, anticipated and/or obvious improvements of the related art.

A plastic polishing material of the related art JPB0197572 by Furudate discloses a broad range of one or more plastic resins mixed with one or more abrasives. The plastic polishing materials of Kodate as in the '416, '993 and '714 patents disclose a more specific plastic resin mixed with one or more abrasives and some include a powder synthetic detergent and some include rotating globular particles. Alternately, the sanding clay of the related art '557 patent by Andrichik disclose a broad range of the plastic resin and abrasives while including approximately up to 5% of a synthetic rubber.

In contrast, the elastic materials of the related art such as in the '859 patent by Inoue disclose elastic and/or elastomeric resin mixed with abrasives in a broad range whereas the elastic and/or elastomeric resin is anywhere from 10% to about 80% in relation to the abrasives of the matrix. The '967 patent by Tsai further discloses a specific composition consisting of what is viewed as 25%-60% elastic material, 10%-20% natural turpentine resin and 15%-30% abrasives, stabilizer, fibers and natural turpentine.

The '724 patent by Heilian further defines a specific design over the '967 patent by Tsai while also introducing contaminant collecting grooves on the elastic material which are longitudinally and transversely formed on the cleaning surface of the cleaning head, wherein the contaminant collecting grooves are intersected with each other on the cleaning surface of the cleaning head in order to prevent the contaminants accumulated by the surface cleaning compound from scratching the working surface and are rinsed away easily.

An operator would receive the full benefit of the presently claimed invention using a polishing material as specified within the disclosures of the '859 patent by Inoue. In contrast, it is not possible that an operator could fully benefit from the presently claimed invention utilizing a material composition as specified in the '967 patent by Tsai.

The matrix of the elastically deformable compressible polishing material according to the present invention allows for a variety of operational and functional advantages. The matrix of the elastically deformable compressible polishing material of the present invention allows it to be used by itself where an operator uses his/her hand as the applicator. Moreover, the matrix of the elastically deformable compressible polishing material of the present invention also allow it to be conveniently affixed to, and/or impregnated on and in, a variety of hard and soft, porous and non-porous substrates such as wood, plastic, rubber, cloth, paper or the like. This is a benefit over the related art because such related art materials are limited in what type of substrates they can be applied to, if any, thereby limiting the usefulness of the polishing method, operations and objectives of the related art.

The matrix of the elastically deformable compressible polishing material according to the present invention can be used by itself without being affixed to a substrate, can be affixed and/or impregnated to/in a variety of substrates and also formed into unique shapes which can be applied to a variety of applicators to maximize the polishing operation and objectives and also to make the polishing operation less time consuming and more convenient for the operator.

The elastically deformable compressible polishing material in one embodiment can be conventionally compounded by one skilled in the art and comprise a matrix of an elastic and/or elastomeric resin mixed with abrasives within a wide formulation range depending on the desired polishing objectives whereas the elastic and/or elastomeric resin is anywhere from 10% to about 80% in relation to the abrasives of the matrix.

Moreover, the matrix of the elastically deformable compressible polishing material of the present invention allows it to accept a variety of sizes and shapes of functional and repeating pattern of reservoirs and raised plateaus. The matrix of the elastically deformable compressible polishing material of the present invention also allow for the functional and repeating pattern of reservoirs and raised plateaus to be received into the elastically deformable compressible polishing material in the manufacturing and/or distribution process, and also at a time as deemed appropriate by the operator in the field during the polishing operation to maximize the function, performance and overall benefit of the presently claimed invention. In a preferred embodiment, the functional and repeating pattern of reservoirs and raised plateaus can be a pattern of a shape, a combination of more than one shape, and/or one shape within another shape and in which the shape can be a geometric and/or non-geometric shape, a letter, a number a symbol or the like, or a combination thereof. Such shapes suitable of forming a functional and repeating pattern of reservoirs and raised plateaus include but are not limited to an ellipse, circle, hexagon, square, diamond, rectangle, triangle, and the like. In another preferred embodiment, the functional and repeating pattern of reservoirs and raised plateaus can incorporate a combination of more than one type of alternating and repeating shapes including, but not limited to octagons with squares, pentagons with triangles, letters, numbers, symbols and the like. In a preferred embodiment, functional and repeating pattern of reservoirs and raised plateaus is a pattern wherein the width of the raised plateaus are approximately 1 millimeter wide and approximately 1 millimeter high and the reservoirs are spaced approximately 6 millimeters apart center to center. In another preferred embodiment, the spacing of the reservoirs is approximately 1 millimeter apart center to center. In another preferred embodiment the spacing of the reservoirs is somewhere between approximately 1 millimeter apart center to center and approximately 6 millimeters apart center to center. In another preferred embodiment the reservoirs are further apart than approximately 6 millimeters center to center. In another preferred embodiment, the width of the raised plateaus are somewhere approximately ⅓ of the center to center spacing of the reservoirs.

In another preferred embodiment the width of the raised plateaus is somewhere approximately the same as the height of the reservoir wall. In another preferred embodiment, the width of the raised plateau is approximately less than the height of the reservoir wall.

In another preferred embodiment, the height of the reservoir wall is approximately greater than the width of the raised plateau. In another preferred embodiment, the height of the reservoir wall is less than the width of the raised plateau.

In another preferred embodiment the center to center spacing of the reservoir is greater than the width of the raised plateau.

In another preferred embodiment, the reservoir wall is somewhat approximately straight. In another preferred embodiment, the reservoir wall is somewhat approximately angled.

The polishing operation according to the present invention comprises a method of applying an elastically deformable compressible polishing material having functional and repeating pattern of reservoirs and raised plateaus to a work surface.

In a preferred embodiment, the polishing operation of the present invention comprises a method of removing strongly adhered foreign matter from a work surface whereas an elastically deformable compressible polishing material having functional and repeating pattern of reservoirs and raised plateaus is applied to a work surface.

In another preferred embodiment the polishing operation comprises the steps of; (a) removing loose matter from the work surface and (b) applying an elastically deformable compressible polishing material having functional and repeating pattern of reservoirs and raised plateaus to a work surface.

In another preferred embodiment the polishing operation comprises the steps of; (a) removing loose matter from the work surface and (b) applying an elastically deformable compressible polishing material having functional and repeating pattern of reservoirs and raised plateaus to a work surface and (c) reciprocating an elastically deformable compressible polishing material having functional and repeating pattern of reservoirs and raises plateaus on the work surface.

In another preferred embodiment the polishing operation comprises the steps of; (a) removing loose matter from the work surface and (b) applying an elastically deformable compressible polishing material having functional and repeating pattern of reservoirs and raised plateaus to a work surface and (c) reciprocating an elastically deformable compressible polishing material having functional and repeating pattern of reservoirs and raises plateaus on the work surface with compressive force.

In another preferred embodiment the polishing operation comprises the steps of; (a) removing loose matter from the work surface and (b) applying an elastically deformable compressible polishing material having functional and repeating pattern of reservoirs and raised plateaus to a work surface and (c) reciprocating an elastically deformable compressible polishing material having functional and repeating pattern of reservoirs and raised plateaus on the work surface with or without compressive force and (d) removing strongly adhered foreign matter from a work surface.

In a preferred embodiment, the polishing operation comprises adding a lubricant to the work surface prior to the polishing operation.

In another preferred embodiment, the polishing operation comprises adding lubricant to the work surface during the polishing operation.

In another preferred embodiment, the polishing operation comprises adding a lubricant to either the work surface or the surface of the elastically deformable compressible polishing material having functional repeating pattern of reservoirs and raised plateaus.

In another preferred embodiment, the lubricant used in the polishing operation comprises water.

During the polishing operation according to the present invention to remove contaminants and/or strongly adhered foreign matter from a work surface, the objective of the polishing operation utilizing the present invention is such that the operator should attempt to not collapse and/or flatten the raised plateaus, unless the elastically deformable compressible polishing material is being cleaned, folded and/or reworked to refresh the surface of the elastically deformable compressible polishing material.

Contamination and/or strongly adhered foreign matter that is removed from a work surface during the polishing operation of the present invention will adhere to the raised plateaus on the elastically deformable compressible polishing material. It is preferred that the elastically deformable compressible polishing material is of a light and/or bright color, however it is not a requirement to receive the full benefits of the present invention.

A functional benefit of the reservoir and raised plateaus of the elastically deformable compressible polishing material of the present invention is that the raised plateaus aid in collecting the strongly adhered foreign matter removed from the work surface and prevent them from collecting into the reservoirs, thus minimizing the amount of overall contamination that is collected on the surface of the elastically deformable compressible polishing material. Because the matrix of the elastically deformable compressible polishing material is also compressible, the contaminants that have collected on the raised plateaus of the elastically deformable compressible polishing material will slightly compress and reduce the risk of scratching the work surface.

Moreover, the collection of the contamination and/or strongly adhered foreign matter on the raised plateaus of the elastically deformable compressible polishing material, which should be visible to the operator, now indicate to the operator that the polishing operation is working properly and the operator is applying the proper movement or force during the polishing operation to accomplish the polishing objective without completely deforming the raised plateaus or reservoirs.

When the operator determines that the raised plateaus of the elastically deformable compressible polishing material can no longer collect additional contamination, this is an indicator to the operator that it is time to clean the elastically deformable compressible polishing material. If the operator fails to pay attention to this step of the polishing procedure, the risk of damaging the work surface is still decreased because the matrix of the elastically deformable compressible polishing material is also compressible and because it contains such functional raised plateaus and lowered reservoirs, the elastically deformable compressible polishing material will simply continue to glide over the work surface with decreased cleaning effects and/or decreased removal of contaminants and/or strongly adhered foreign matter from the work surface without damaging the work surface.

Once the raised plateaus of the elastically deformable compressible polishing material, according to the present invention, have removed and collected contaminants and/or strongly adhered foreign matter from the work surface during a polishing operation, the operator now has a multitude of options on how to proceed according to the present invention. With the present invention, the operator has the option to either: (a) determine that there is enough clean space on the raised plateaus of the elastically deformable compressible polishing material to continue the polishing operation further; (b) spray the surface of the elastically deformable compressible polishing material with liquid and wipe it to clean the raised plateaus of the elastically deformable compressible polishing material; (c) renew the surface of the elastically deformable compressible polishing material by forming new functional and repeating pattern of reservoirs and raised plateaus into the elastically deformable compressible polishing material; (e) turn over, fold, knead and/or rework the elastically deformable compressible polishing material; or (f) discard the elastically deformable compressible polishing material.

Another benefit of the polishing operation of the present invention in which the strongly adhered foreign matter is collected on the raised plateaus and not in the lowered reservoirs and is a significant advantage over the related art. The raised plateaus of the elastically deformable compressible polishing material having a functional and repeating pattern of lowered reservoirs and raised plateaus provides the operator with an option to clean the raised plateaus and prevents such strongly adhered foreign matter from being redistributed onto the work surface. The matrix of the elastically deformable compressible polishing material of the present invention combined with the functional repeating pattern of lowered reservoirs and raised plateaus has significant functional and operational advantages over the related art.

The elastically deformable compressible polishing material having functional repeating pattern of lowered reservoirs and raised plateaus has an elastically deformable compressible matrix which allows the strongly adhered foreign matter to adhere to the raised plateaus and not to be collected in the lowered reservoirs. Moreover, the strongly adhered foreign matter which has collected and adhered on the raised plateaus is not rinsed away easily from the raised plateaus with water or during the polishing operation as opposed to the related art in the '967 patent by Tsai and the '724 patent by Heilian. One embodiment of the present invention requires that the operator clean the raised plateaus by wiping which causes frictional force to loosen the foreign matter from the raised plateau and in turn prevents the collected matter from being redistributed onto the work surface, and allows the operator to collect the foreign mater on a separate material that is not being put in contact with the work surface and thus decreasing the chance that damage to the work surface will occur. Thus, this functional and claimed benefit allows the operator to collect the strongly adhered foreign matter from the raised plateaus of the elastically deformable compressible material having functional repeating pattern of reservoirs and raised plateaus onto a separate substrate material away from the work surface. This is a significant useful and operational feature over the related art.

In a preferred embodiment of the present invention, the polishing operation comprises the steps of cleaning the raised plateaus with an absorbent material.

A preferred embodiment of the present invention comprises the steps of (a) removing loose matter from the work surface and (b) applying an elastically deformable compressible polishing material having functional and repeating pattern of reservoirs and raised plateaus to a work surface and (c) reciprocating an elastically deformable compressible polishing material having functional and repeating pattern of reservoirs and raised plateaus on the work surface either with, or without, compressive force and (d) removing strongly adhered foreign matter from a work surface, (e) collecting such strongly adhered foreign matter on the raised plateaus of the elastically deformable compressible polishing material, (f) spraying a lubricant on the surface of the elastically deformable compressible polishing material having a functional repeating pattern of reservoirs and raised plateaus and (e) wiping and removing the strongly adhered foreign matter from the raised plateaus and collecting them onto a separate absorbent material.

The related art which discloses the mixture article of the '967 by Tsai and the '724 by Heilian having adhesive gaps and ridges and more specifically defined grooves which are "longitudinally and transversely formed on the cleaning surface" disclose that the collected contaminants can be "rinsed away easily with water." However, the operational disadvantage of this related art polishing operation is that the contaminants that are removed from the work surface are repeatedly re-deposited onto the work surface during the polishing operation thus causing additional work and the potential for more damage to the work surface during the polishing operation. While the '967 patent by Tsai doesn't require the use of water during the polishing operation, those skilled in the art realize that a polishing operation using the material as claimed by the '967 patent by Tsai without the use of water would simply not function properly and moreover would cause significant damage to a coated work surface. Moreover, while the '724 patent by Heilian discloses using water during the polishing operation, the operational disadvantage of this is that the "contaminant collecting grooves" which are "longitudinally and transversely formed on the cleaning surface" would cause the contaminants to be re-deposited onto the work surface thereby causing both increased work for the operator and potential damage to the coated work surface.

However, as discussed previously an operational disadvantage of the mixture article of the '967 patent by Tsai is that paint overspray causes a permanent "clogging phenomenon" of the material which causes a malfunction during the polishing operation and renders the mixture article useless. The mixture article of the elastically deformable compressible polishing material having functional repeating pattern of lowered reservoirs and raised plateaus of the present invention has another specific operational advantage over the '967 material by Tsai in that the elastically deformable compressible polishing material having functional repeating pattern of lowered reservoirs and raised plateaus of the present invention can remove strongly adhered foreign matter including but not limited to paint overspray from a work surface and such that, the elastically deformable compressible polishing material having repeating pattern of lowered reservoirs and raised plateaus can be cleaned of the paint overspray that has been collected.

An objective and claimed benefit of the polishing operation according to the present invention is to provide an efficient and effective means such that an operator can accomplish a polishing operation on a coated or non-coated work surface to remove a variety of strongly adhered foreign matter, including but not limited to paint overspray, iron mist, brake dust, tree sap, bug residue, industrial fallout, and many other type of pollutants and strongly adhered foreign matter.

Another claimed benefit of the present invention is to aid the user in the cleaning, folding, kneading and/or renewing the surface of the elastically deformable compressible polishing material. If the operator is using the elastically deformable compressible polishing material by itself, not on a substrate or with an applicator other than the operators own hand, then the operator can press new functional and repeating pattern of lowered reservoirs and raised plateaus into the elastically deformable compressible polishing material with a special tool. Another claimed benefit of the present invention is such that the elastically deformable compressible polishing material will fold with much less effort due to the lowered reservoirs having been formed into the elastically deformable compressible polishing material, thus aiding the polishing operation and reducing operator fatigue.

Another claimed benefit of the present invention is also to allow the operator to form new functional and repeating pattern of lowered reservoirs and raised plateaus in an elastically deformable compressible polishing material that is adhered to a substrate. In this embodiment of the present invention, the operator would not have the option of folding or kneading the elastically deformable compressible polishing material and would instead benefit from the presently claimed invention through either the cleaning of the raised plateaus, or forming new functional and repeating pattern of lowered reservoirs and raised plateaus in the elastically deformable compressible polishing material, or both.

Another claimed benefit of the present invention is that if the user notices that contamination has adhered to the plateaus of the elastically deformable compressible polishing material, the operator can intentionally flatten the surface of the elastically deformable compressible polishing material and then make new functional and repeating pattern of lowered reservoirs and raised plateaus without folding, kneading and/or reworking by use of a special tool. This function and option is possible due to the lowered reservoirs in the elastically deformable compressible polishing material that remain substantially uncontaminated. Since the raised plateaus have collected most of the contaminants from the work surface, and prevented them from collecting on the surface of the lowered reservoir which make up a larger percentage of the surface area of the elastically deformable compressible polishing material then the raised plateaus, this is a functional benefit which maximizes the longevity of the elastically deformable compressible polishing material, while saving time, associated costs and user fatigue associated with folding, reworking and/or kneading of the elastically deformable compressible polishing material. If the operator is using excessive compressive force and collapses the raised plateaus into the lowered reservoirs without folding the elastically deformable compressible polishing material, when pressing a new functional and repeating pattern of lowered reservoirs and raised plateaus into the elastically deformable compressible polishing material, the lowered reservoirs which were previously free of contaminants, are now transformed from lowered reservoirs into raised plateaus, which are also substantially free of contaminants.

It is possible for a user to refresh the lowered reservoirs and raised plateaus in the elastically deformable compressible polishing material in a variety of ways. In one embodiment refreshing the lowered reservoirs and raised plateaus in the elastically deformable compressible polishing material can be done through the use of a tool to remake the lowered reservoirs and raised plateaus in the elastically deformable compressible polishing material. In another embodiment refreshing the lowered reservoirs and raised plateaus in the elastically deformable compressible polishing material can be done by spraying the elastically deformable compressible polishing material with a liquid lubricant and/or detail spray as it is known in the art which comprises 98% water and less than 2% of surfactants, emulsifiers and oils and then wiping the elastically deformable compressible polishing material clean with a user's hand. In still another embodiment refreshing the lowered reservoirs and raised plateaus in the elastically deformable compressible polishing material can be done by spraying with a liquid lubricant and/or detail spray and then wiping the elastically deformable compressible polishing material clean with a non-absorbent material. While in yet another embodiment refreshing the lowered reservoirs and raised plateaus in the elastically deformable compressible polishing material can be done by spraying with a liquid lubricant and/or detail spray and then wiping the elastically deformable compressible polishing material clean with an absorbent material. While in still another embodiment refreshing the lowered reservoirs and raised plateaus in the elastically deformable compressible polishing material can be done by folding, kneading, or reworking the elastically deformable compressible polishing material then using a tool to remake the lowered reservoirs and raised plateaus in the elastically deformable compressible polishing material.

Another embodiment of the present invention provides the operator with a means for making the functional and repeating pattern of lowered reservoirs and raised plateaus in an elastically deformable compressible polishing material. Accordingly, the tool itself can comprise many different configurations and can even be in the form of a storage container, such as a flat article, a curved article, a cylindrical article, a spherical article, a square article, rectangle article and the like. Accordingly the size and shape a tool would be suitable as long as at least a surface region of the tool comprises a raised pattern such that when contacted with an elastically deformable compressible polishing material it is capable of forming functional and repeating pattern of lowered reservoirs and raised plateaus. A suitable tool would be made available to the operator of a polishing operation such that the operator can make, and remake, functional and repeating pattern of lowered reservoirs and raised plateaus on the elastically deformable compressible polishing material to maximize performance, reduce costs and polishing operation time while maximizing longevity and functionality of the elastically deformable compressible polishing material according to the present invention.

An additional embodiment of the present invention is to provide a "kit" for the operator to conveniently receive the full benefit of this invention. A preferred embodiment of the presently claimed invention would comprise an elastically deformable compressible polishing material with, or without, pre-formed functional and repeating pattern of lowered reservoirs and raised plateaus as well as a means for the operator to make, or remake, raised plateaus and lowered reservoirs on the elastically deformable compressible polishing material.

Elastically deformable compressible polishing materials having the proper matrix to receive such functional and repeating pattern of reservoirs and raised plateaus for the operator to receive the full benefit of the present invention can be produced and made available by those skilled in the art.

Further features of the invention, its nature and various advantages will be more apparent from the accompanying drawings and the following detailed description of the preferred embodiments.

DETAILED DESCRIPTION

Figure 1A:
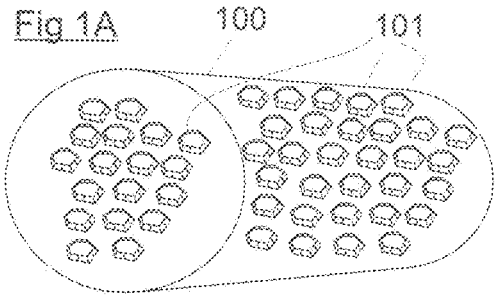
FIGS. 1A to 1F shows several illustrative examples of containers where a surface of the container is a tool for creating or reforming a functional and repeating pattern of lowered reservoirs and raised plateaus on one or more surface regions, or areas, of an elastically deformable compressible polishing material.

In one embodiment a surface cleaning device can comprise an elastically deformable compressible polishing material capable of having created on at least one surface a plurality of lowered reservoirs, each lowered reservoir having at least one side and at least one bottom, and a plurality of raised plateaus; a tool having a plurality of raised areas for creating a portion of the plurality of lowered reservoirs, and a plurality of lowered areas for creating a portion of the plurality of raised plateaus, on the at least one surface of the elastically deformable compressible polishing material; the tool placed into contact at with the at least one surface of the elastically deformable compressible polishing material; and a compressive force applied to the tool and the elastically deformable compressible polishing material to create the plurality of lowered reservoirs and the plurality of raised plateaus on the at least one surface of the elastically deformable compressible polishing material wherein the plurality of lowered reservoirs and the plurality of raised plateaus form a repeating pattern of shapes on the at least one surface of the elastically deformable compressible polishing material and wherein the plurality of raised plateaus are capable of collecting and removing strongly adhered foreign matter from a work surface while the plurality of lowered reservoirs are capable of remaining substantially free of strongly adhered foreign matter.

In yet still another embodiment the plurality of lowered reservoirs each having at least one side and at least one bottom can have the at least one side form a right angle to the at least one bottom.

Moreover in another embodiment the plurality of lowered reservoirs each having at least one side and at least one bottom can have the at least one side form an obtuse angle to the at least one bottom.

In another embodiment the plurality of lowered reservoirs and the plurality of raised plateaus on the at least one surface of the elastically deformable compressible polishing material can be created during manufacture of the elastically deformable compressible polishing material.

Moreover, in another embodiment the plurality of lowered reservoirs and the plurality of raised plateaus on the at least one surface of the elastically deformable compressible polishing material can be created during packaging of the elastically deformable compressible polishing material.

While in yet another embodiment the plurality of lowered reservoirs and the plurality of raised plateaus on the at least one surface of the elastically deformable compressible polishing material can be created by a user of the elastically deformable compressible polishing material.

In yet another embodiment the plurality of lowered reservoirs and the plurality of raised plateaus on the at least one surface of the elastically deformable compressible polishing material can be refreshed by a user with a tool.

In yet still another embodiment the tool is can be on at least one surface a container capable of holding the elastically deformable compressible polishing material.

Additionally, in yet another embodiment the elastically deformable compressible polishing material can be removably affixed to an applicator.

In another embodiment at least one surface of the applicator can be the tool.

In yet another embodiment the applicator can be a human hand containing the tool.

While in still another embodiment the applicator can be a porous material containing the tool.

While in yet another embodiment the applicator can be a non-porous material containing the tool.

Additionally, in another embodiment a portion of the plurality of lowered reservoirs can be spaced apart approximately 1 millimeter from a center of a first lowered reservoir among the plurality of lowered reservoirs to a plurality of centers of the portion of the plurality of lowered reservoirs in close proximity to the first lowered reservoir.

In another embodiment a portion of the plurality of lowered reservoirs can be spaced apart approximately 6 millimeters from a center of a first lowered reservoir among the plurality of lowered reservoirs to a plurality of centers of the portion of the plurality of lowered reservoirs in close proximity to the first lowered reservoir.

In yet another embodiment a portion of the plurality of lowered reservoirs can be spaced apart between approximately 1 millimeters and 6 millimeters from a center of a first lowered reservoir among the plurality of lowered reservoirs to a plurality of centers of the portion of the plurality of lowered reservoirs in close proximity to the first lowered reservoir.

In still another embodiment the plurality of lowered reservoirs each having at least one side and at least one bottom can have the at least one side can be approximately 1 mm in height from the at least one bottom to adjacent portions of the plurality of raised plateaus in close proximity thereto.

Furthermore, in another embodiment the plurality of lowered reservoirs each having at least one side and at least one bottom, the at least one side can be approximately 1 mm in height from the at least one bottom to the adjacent portions of the plurality of raised plateaus in close proximity thereto, and the adjacent portions of the plurality of raised plateaus in close proximity thereto can be approximately 1 millimeter wide.

Additionally, in yet another embodiment a portion of the plurality of raised plateaus can be spaced apart approximately 1 millimeter from a center of a first raised plateau among the plurality of raised plateaus to a plurality of centers of the portion of the plurality of raised plateaus in close proximity to the first raised plateau.

Moreover, in yet another embodiment a portion of the plurality of raised plateaus can be spaced apart approximately 6 millimeters from a center of a first raised plateau among the plurality of raised plateaus to a plurality of centers of the portion of the plurality of raised plateaus in close proximity to the first raised plateau.

In another embodiment a portion of the plurality of raised plateaus can be spaced apart between approximately 1 millimeters and 6 millimeters from a center of a first raised plateau among the plurality of raised plateaus to a plurality of centers of the portion of the plurality of raised plateaus in close proximity to the first raised plateau.

Moreover, in another embodiment a surface cleaning device can further comprise a liquid lubricant being applied to the elastically deformable compressible polishing material having the plurality of lowered reservoirs and the plurality of raised plateaus on the at least one surface that is removably affixed to the applicator, or to the work surface, or to both; the elastically deformable compressible polishing material having the plurality of lowered reservoirs and the plurality of raised plateaus on the at least one surface that is removably affixed to the applicator can be placed in contact with the work surface; a compressive force can be applied to the elastically deformable compressible polishing material having the plurality of lowered reservoirs and the plurality of raised plateaus on the at least one surface that is removably affixed to the applicator; the elastically deformable compressible polishing material having the plurality of lowered reservoirs and the plurality of raised plateaus on the at least one surface that is removably affixed to the applicator can be moved across the work surface while in contact with the work surface to remove strongly adhered foreign matter from the work surface; the elastically deformable compressible polishing material having the plurality of lowered reservoirs and the plurality of raised plateaus on the at least one surface that is removably affixed to the applicator can be removed from the work surface; the plurality of lowered reservoirs and the plurality of raised plateaus can be visually inspected to determine whether a correct amount of compressive force was applied; the plurality of lowered reservoirs and the plurality of raised plateaus can be visually inspected to determine if strongly adhered foreign matter have been removed from the work surface and collected on the plurality of raised plateaus; and if an incorrect amount of compressive force was applied, or if strongly adhered foreign matter is found on the plurality of raised plateaus, or both, then the plurality of lowered reservoirs and the plurality of raised plateaus can be refreshed.

Additionally, in another embodiment a surface cleaning device can further comprise a liquid lubricant being applied to the elastically deformable compressible polishing material having the plurality of lowered reservoirs and the plurality of raised plateaus on the at least one surface that is removably affixed to the applicator, or to the work surface, or to both; the elastically deformable compressible polishing material having the plurality of lowered reservoirs and the plurality of raised plateaus on the at least one surface can be placed in contact with the work surface; the elastically deformable compressible polishing material having the plurality of lowered reservoirs and the plurality of raised plateaus on the at least one surface can be moved across the work surface while in contact with the work surface to remove strongly adhered foreign matter from the work surface; the elastically deformable compressible polishing material having the plurality of lowered reservoirs and the plurality of raised plateaus on the at least one surface can be removed from the work surface; the plurality of lowered reservoirs and the plurality of raised plateaus can be visually inspected to determine if strongly adhered foreign matter have been removed from the work surface and collected on the plurality of raised plateaus; and if strongly adhered foreign matter is found on the plurality of raised plateaus, then the plurality of lowered reservoirs and the plurality of raised plateaus can be refreshed.

Furthermore a surface cleaning device can comprise an elastically deformable compressible polishing material capable of having created on at least one surface a plurality of lowered reservoirs, each lowered reservoir having at least one side and at least one bottom, and a plurality of raised plateaus; a tool having a plurality of raised areas for creating a portion of the plurality of lowered reservoirs, and a plurality of lowered areas for creating a portion of the plurality of raised plateaus, on the at least one surface of the elastically deformable compressible polishing material; the tool placed into contact at with the at least one surface of the elastically deformable compressible polishing material; a compressive force can be applied to the tool and the elastically deformable compressible polishing material to create the plurality of lowered reservoirs and the plurality of raised plateaus on the at least one surface of the elastically deformable compressible polishing material wherein the plurality of lowered reservoirs and the plurality of raised plateaus form a repeating pattern of shapes on the at least one surface of the elastically deformable compressible polishing material and wherein the raised plateaus are capable of removing and collecting strongly adhered foreign matter from a work surface while the lowered reservoirs remain substantially free of strongly adhered foreign matter; a liquid lubricant can be applied to the elastically deformable compressible polishing material having the plurality of lowered reservoirs and the plurality of raised plateaus on the at least one surface that is removably affixed to the applicator, or to the work surface, or to both; the elastically deformable compressible polishing material having the plurality of lowered reservoirs and the plurality of raised plateaus on the at least one surface can be placed in contact with the work surface; the elastically deformable compressible polishing material having the plurality of lowered reservoirs and the plurality of raised plateaus on the at least one surface can be moved across the work surface while in contact with the work surface to remove strongly adhered foreign matter from the work surface; the elastically deformable compressible polishing material having the plurality of lowered reservoirs and the plurality of raised plateaus on the at least one surface can be removed from the work surface; the plurality of lowered reservoirs and the plurality of raised plateaus can be visually inspected to determine if strongly adhered foreign matter have been removed from the work surface and collected on the plurality of raised plateaus; and if strongly adhered foreign matter is found on the plurality of raised plateaus, then the plurality of lowered reservoirs and the plurality of raised plateaus can be refreshed.

In another embodiment a surface cleaning method can comprise obtaining an elastically deformable compressible polishing means; obtaining a means for creating a plurality of lowered reservoirs and a plurality of raised plateaus on at least one surface of the elastically deformable compressible polishing means; placing the means for creating a plurality of lowered reservoirs and a plurality of raised plateaus into contact at with the at least one surface of the elastically deformable compressible polishing means; applying a compressive force to the means for creating a plurality of lowered reservoirs and a plurality of raised plateaus on the elastically deformable compressible polishing means; and creating a repeating pattern of shapes on the at least one surface of the elastically deformable compressible polishing means wherein the plurality of raised plateaus are capable of removing and collecting strongly adhered foreign matter from a work surface while the plurality of lowered reservoirs are capable of remaining substantially free of strongly adhered foreign matter.

Additionally, in another embodiment can further comprise a user refreshing the plurality of lowered reservoirs and the plurality of raised plateaus on at least one surface of the elastically deformable compressible polishing means using the means for creating a plurality of lowered reservoirs and a plurality of raised plateaus on at least one surface of the elastically deformable compressible polishing means.

Furthermore, in yet another embodiment the means for creating a plurality of lowered reservoirs and a plurality of raised plateaus on at least one surface of the elastically deformable compressible polishing means can comprise at least one surface a container capable of holding the elastically deformable compressible polishing means.

Moreover, in another embodiment creating the repeating pattern of shapes on the at least one surface of the elastically deformable compressible polishing means can occur during manufacturing of the elastically deformable compressible polishing means.

Additionally, in yet another embodiment creating the plurality of lowered reservoirs and the plurality of raised plateaus on the at least one surface of the elastically deformable compressible polishing means can occur during packaging of the elastically deformable compressible polishing means.

Furthermore, in another embodiment the plurality of lowered reservoirs and the plurality of raised plateaus on the at least one surface of the elastically deformable compressible polishing material can be created by a user using the means for creating the a plurality of lowered reservoirs and a plurality of raised plateaus on at least one surface of the elastically deformable compressible polishing means.

Moreover, another embodiment can further comprise a user refreshing the plurality of lowered reservoirs and the plurality of raised plateaus on at least one surface of the elastically deformable compressible polishing means using the means for creating a plurality of lowered reservoirs and a plurality of raised plateaus on at least one surface of the elastically deformable compressible polishing means.

Additionally, in another embodiment can further comprise removably affixing the surface cleaning means to an applicator means.

Furthermore, in another embodiment at least one surface of the applicator means can comprise the means for creating a plurality of lowered reservoirs and a plurality of raised plateaus on at least one surface of the elastically deformable compressible polishing means.

Moreover, in another embodiment a surface cleaning method can further comprise applying a liquid lubricant to the elastically deformable compressible polishing means having the plurality of lowered reservoirs and the plurality of raised plateaus on the at least one surface that is removably affixed to the applicator means, or to the work surface, or to both; placing in contact with the work surface the elastically deformable compressible polishing means having the plurality of lowered reservoirs and the plurality of raised plateaus in the repeating pattern of shapes on the at least one surface that is removably affixed to the applicator means; applying a compressive force to the elastically deformable compressible polishing means having the plurality of lowered reservoirs and the plurality of raised plateaus in the repeating pattern of shapes on the at least one surface that is removably affixed to the applicator means; moving the elastically deformable compressible polishing means having the plurality of lowered reservoirs and the plurality of raised plateaus in the repeating pattern of shapes on the at least one surface that is removably affixed to the applicator means across the work surface while maintaining contact with the work surface thereby removing and collecting strongly adhered foreign matter from a work surface; removing the elastically deformable compressible polishing means having the plurality of lowered reservoirs and the plurality of raised plateaus in the repeating pattern of shapes on the at least one surface that is removably affixed to the applicator means from the work surface; inspecting the elastically deformable compressible polishing means having the plurality of lowered reservoirs and the plurality of raised plateaus in the repeating pattern of shapes on the at least one surface that is removably affixed to the applicator means; determining if a correct amount of compressive force was applied; determining if strongly adhered foreign matter have been removed from the work surface and collected on the plurality of raised plateaus on the at least one surface of the elastically deformable compressible polishing means and the plurality of lowered reservoirs have remained substantially free of strongly adhered foreign matter; and refreshing the elastically deformable compressible polishing means having the plurality of lowered reservoirs and the plurality of raised plateaus in the repeating pattern of shapes on the at least one surface if an incorrect amount of compressive force was applied or if strongly adhered foreign matter are found on the plurality of raised plateaus.

Additionally, in another embodiment the applicator means can be a human hand containing the means for creating the plurality of lowered reservoirs and the plurality of raised plateaus on the at least one surface of the elastically deformable compressible polishing means.

Moreover, in another embodiment the applicator means can be a porous material containing the means for creating the plurality of lowered reservoirs and the plurality of raised plateaus on the at least one surface of the elastically deformable compressible polishing means.

Furthermore, in another embodiment the applicator means can be a non-porous material containing the means for creating the plurality of lowered reservoirs and the plurality of raised plateaus on the at least one surface of the elastically deformable compressible polishing means.

Additionally the surface cleaning method defined can further comprise: applying a liquid lubricant to the elastically deformable compressible polishing means having the plurality of lowered reservoirs and the plurality of raised plateaus on the at least one surface that is removably affixed to the applicator means, or to the work surface, or to both; placing in contact with a work surface the elastically deformable compressible polishing means having the plurality of lowered reservoirs and the plurality of raised plateaus in the repeating pattern of shapes on the at least one surface; moving the elastically deformable compressible polishing means having the plurality of lowered reservoirs and the plurality of raised plateaus in the repeating pattern of shapes on the at least one surface across the work surface while maintaining contact with the work surface thereby removing and collecting strongly adhered foreign matter from the work surface; removing the elastically deformable compressible polishing means having the plurality of lowered reservoirs and the plurality of raised plateaus in the repeating pattern of shapes on the at least one surface from the work surface; inspecting the elastically deformable compressible polishing means having the plurality of lowered reservoirs and the plurality of raised plateaus in the repeating pattern of shapes on the at least one surface; determining if strongly adhered foreign matter have been removed from the work surface and collected on the plurality of raised plateaus on the at least one surface of the elastically deformable compressible polishing means and the plurality of lowered reservoirs have remained substantially free of strongly adhered foreign matter; and refreshing the elastically deformable compressible polishing means having the plurality of lowered reservoirs and the plurality of raised plateaus in the repeating pattern of shapes on the at least one surface if strongly adhered foreign matter are found on the plurality of raised plateaus.

Furthermore, a surface cleaning method can comprise obtaining an elastically deformable compressible polishing means; obtaining a means for creating a plurality of lowered reservoirs and a plurality of raised plateaus on at least one surface of the elastically deformable compressible polishing means; placing the means for creating a plurality of lowered reservoirs and a plurality of raised plateaus into contact at with the at least one surface of the elastically deformable compressible polishing means; applying a compressive force to the means for creating a plurality of lowered reservoirs and the elastically deformable compressible polishing means; creating a plurality of lowered reservoirs and a plurality of raised plateaus in a repeating pattern of shapes on the at least one surface of the elastically deformable compressible polishing means; applying a liquid lubricant to the elastically deformable compressible polishing means having the plurality of lowered reservoirs and the plurality of raised plateaus on the at least one surface that is removably affixed to the applicator means, or to the work surface, or to both; placing the elastically deformable compressible polishing means having the plurality of lowered reservoirs and the plurality of raised plateaus in the repeating pattern of shapes on the at least one surface in contact with the work surface; moving the elastically deformable compressible polishing means having the plurality of lowered reservoirs and the plurality of raised plateaus in the repeating pattern of shapes on the at least one surface across the work surface while in contact with the work surface thereby removing and collecting strongly adhered foreign matter from a work surface; removing the elastically deformable compressible polishing means having the plurality of lowered reservoirs and the plurality of raised plateaus in the repeating pattern of shapes on the at least one surface from the work surface; inspecting the elastically deformable compressible polishing means having the plurality of lowered reservoirs and the plurality of raised plateaus in the repeating pattern of shapes on the at least one surface; determining if strongly adhered foreign matter have collected on the plurality of raised plateaus on the at least one surface of the elastically deformable compressible polishing means while the plurality of lowered reservoirs have remained substantially free of strongly adhered foreign matter; and refreshing the elastically deformable compressible polishing means having the plurality of lowered reservoirs and the plurality of raised plateaus in the repeating pattern of shapes on the at least one surface if strongly adhered foreign matter are found on the plurality of raised plateaus.

Turning now to FIG. 1A, it shows an illustrative cylindrical container 100 capable of containing an elastically deformable compressible polishing material where the surface of the container can include the tool for creating the plurality of lowered reservoirs and the plurality of raised plateaus in the repeating pattern of shapes on the at least one surface 101.

Figure 1B:
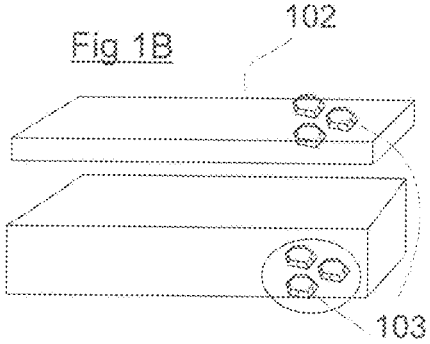

Turning now to FIG. 1B, it shows an illustrative polyhedron container 102 capable of containing an elastically deformable compressible polishing material where the surface of the container can include the tool for creating the plurality of lowered reservoirs and the plurality of raised plateaus in the repeating pattern of shapes on the at least one surface 103.

Figure 1C:
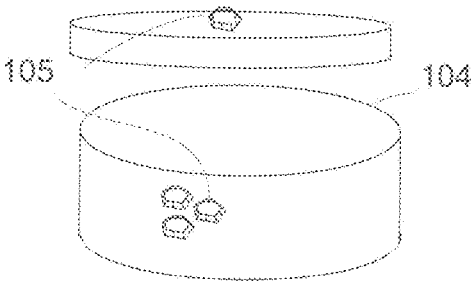

Turning now to FIG. 1C, it shows an illustrative cylindrical container 104 capable of containing an elastically deformable compressible polishing material where the surface of the container can include the tool for creating the plurality of lowered reservoirs and the plurality of raised plateaus in the repeating pattern of shapes on the at least one surface 105.

Figure 1D:
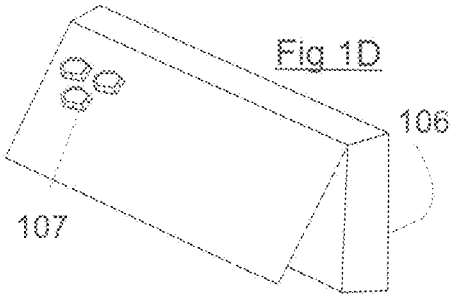

Turning now to FIG. 1D, it shows an illustrative polyhedron container 106 capable of containing an elastically deformable compressible polishing material where the surface of the container can include the tool for creating the plurality of lowered reservoirs and the plurality of raised plateaus in the repeating pattern of shapes on the at least one surface 107.

Figure 1E:
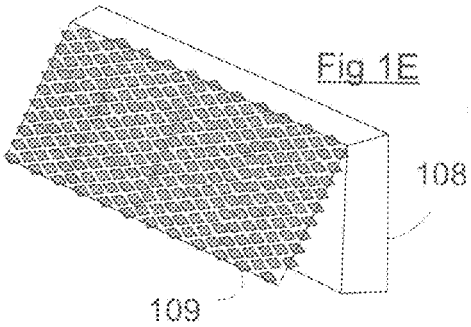

Turning now to FIG. 1E, it shows an illustrative polyhedron container 108 capable of containing an elastically deformable compressible polishing material where the surface of the container can include the tool for creating the plurality of lowered reservoirs and the plurality of raised plateaus in the repeating pattern of shapes on the at least one surface 109.

Figure 1F:
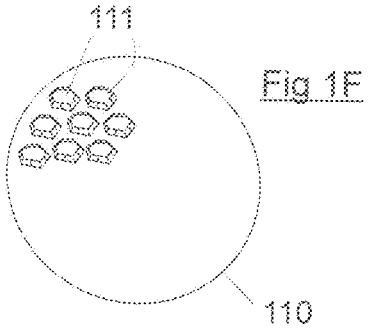

Turning now to FIG. 1F, it shows an illustrative spherical container 110 capable of containing an elastically deformable compressible polishing material where the surface of the container can include the tool for creating the plurality of lowered reservoirs and the plurality of raised plateaus in the repeating pattern of shapes on the at least one surface 111.

Figure 2:
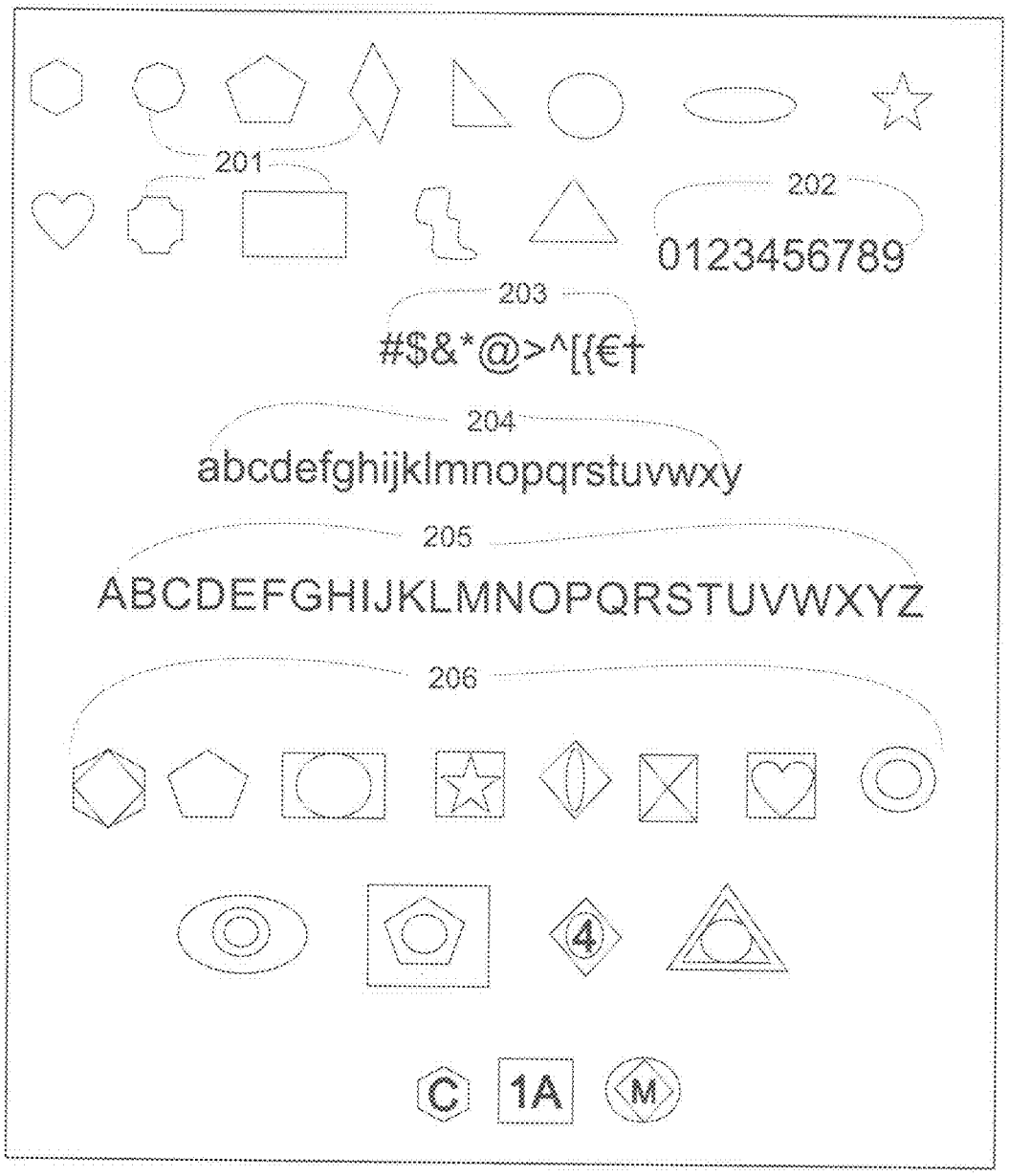
FIG. 2 shows various illustrative examples of geometrical and non geometrical shapes which can be used to make functional repeating patterns of reservoirs and raised plateaus on an elastically deformable compressible polishing material.

Turning now to FIG. 2, it shows illustrative examples of shapes, including but not limited to, geometric shapes 201, numbers, 202, symbols, 203, lower case letters 204, upper case letters 205, and shapes within shapes or numbers or letters within shapes 206 that can be used in creating the repeating pattern of lowered reservoirs and the plurality of raised plateaus in the repeating pattern of shapes on the at least one surface of an elastically deformable compressible polishing material.

Figure 3:
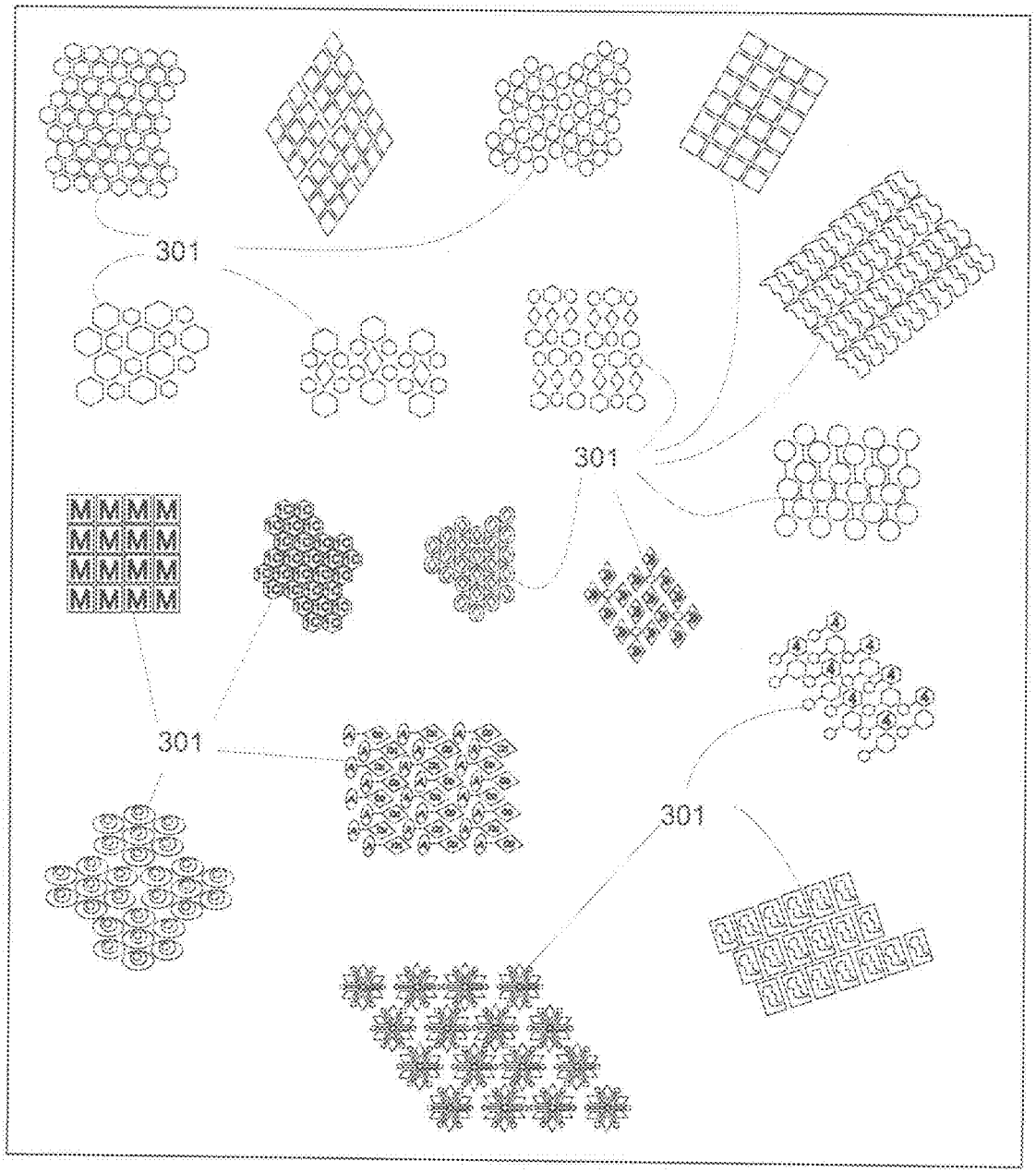
FIG. 3 shows various illustrative examples of patterns of geometric and non geometric shapes, letters, numbers, symbols and a combination of the like to form a functional repeating pattern of lowered reservoirs and raised plateaus on an elastically deformable compressible polishing material.

Now turning to FIG. 3, it shows illustrative examples of patterns of geometric and non geometric shapes, letters, numbers, symbols and a combination of the like 301 to form a functional repeating pattern of lowered reservoirs and raised plateaus on an elastically deformable compressible polishing material.

Figure 4A:
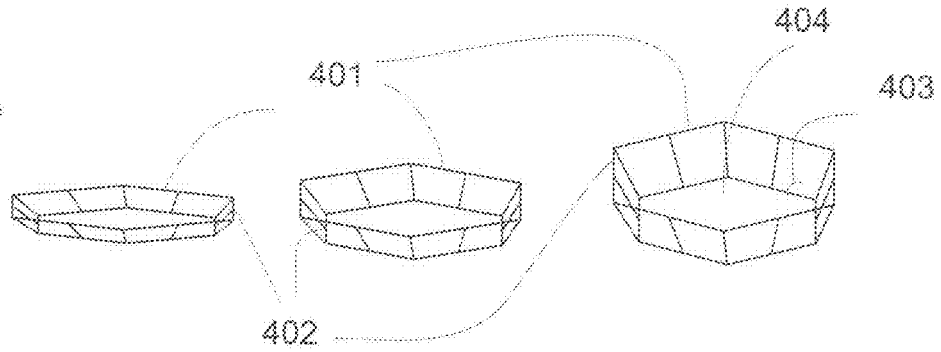
FIG. 4A shows various illustrative examples of lowered reservoirs where the reservoir walls are of varying heights and form an obtuse angle with the reservoir bottom and FIG. 4B various illustrative examples of lowered reservoirs where the reservoir walls are of varying heights and form a right angle with the reservoir bottom.

Now turning to FIG. 4A, it shows illustrative examples of lowered reservoirs 401 where the reservoir walls 402 are of varying heights and form an obtuse angle 403 with the reservoir bottom 404.

Figure 4B:
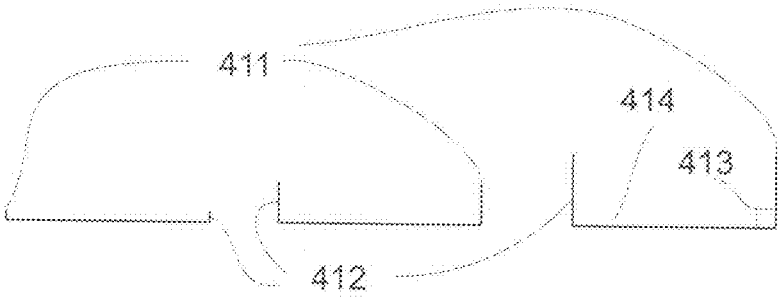

Turning now to FIG. 4B it shows illustrative examples of lowered reservoirs 411 where the reservoir walls 412 are of varying heights and form a right angle 413 with the reservoir bottom 414.

Figure 5A:
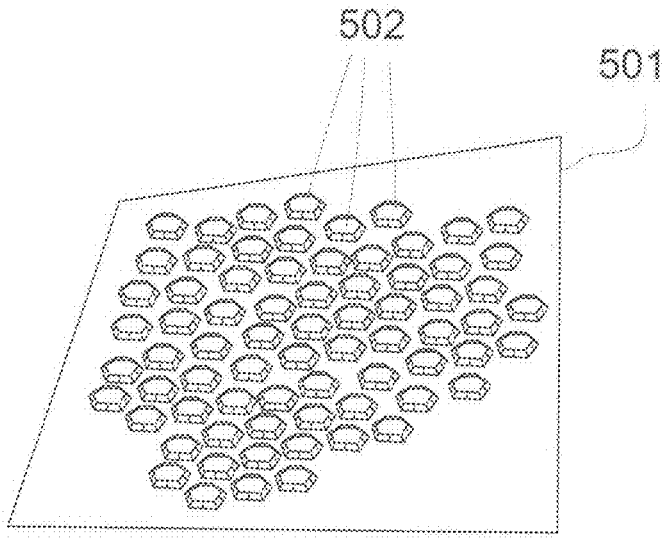
FIG. 5A is a perspective view of an illustrative tool having a functional repeating pattern of raised portions, such that the tool is capable of forming a functional repeating pattern of lowered reservoirs and raised plateaus in an elastically deformable compressible polishing material

Now turning to FIG. 5A, it shows is a perspective view of an illustrative tool 501 having a functional repeating pattern of raised portions 502, such that the tool is capable of forming a functional repeating pattern of lowered reservoirs and raised plateaus in an elastically deformable compressible polishing material.

Figure 5B:
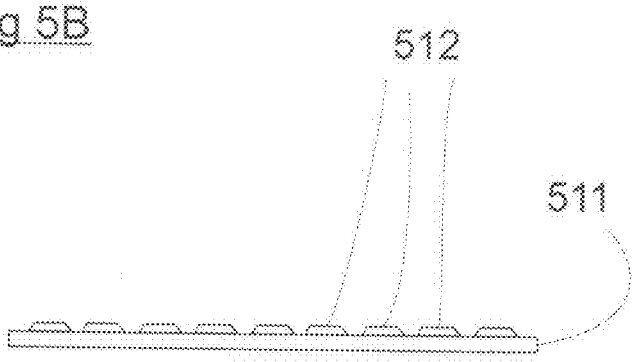
FIG. 5B is a side view of an illustrative tool having a functional repeating pattern of raised portions, such that the tool is capable of forming a functional repeating pattern of lowered reservoirs and raised plateaus in an elastically deformable compressible polishing material.

Turning now to FIG. 5B, it shows is a side view of an illustrative tool 511 having a functional repeating pattern of raised portions 512, such that the tool is capable of forming a functional repeating pattern of lowered reservoirs and raised plateaus in an elastically deformable compressible polishing material.

Figure 6:
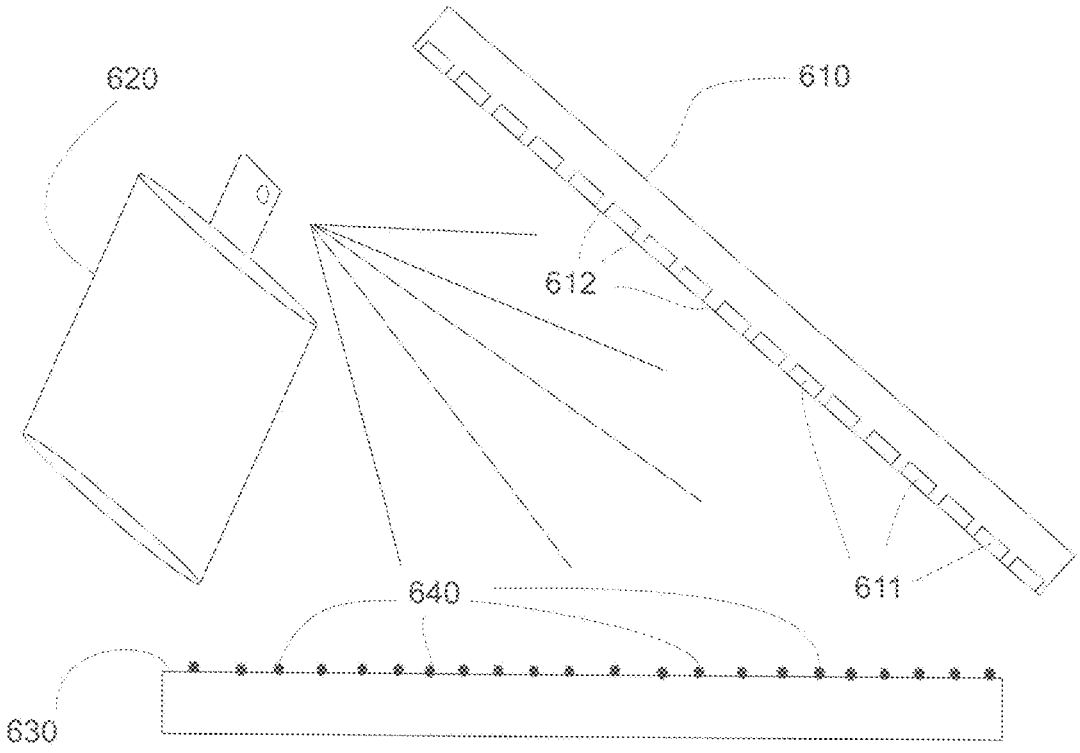
FIG. 6 is a side view of an illustrative elastically deformable compressible polishing material having functional repeating pattern of lowered reservoirs and raised plateaus having a liquid lubricant being applied to it, or to a work surface containing strongly adhered foreign matter, or to both.

Now turning to FIG. 6, it shows a side view of an illustrative elastically deformable compressible polishing material 610 having functional repeating pattern of lowered reservoirs 611 and raised plateaus 612 having a liquid lubricant 620 being applied to elastically deformable compressible polishing material 610 having functional repeating pattern of lowered reservoirs 611 and raised plateaus 612, or to a work surface 630 containing strongly adhered foreign matter 640, or to both the elastically deformable compressible polishing material 610 having functional repeating pattern of lowered reservoirs 611 and raised plateaus 612 and the work surface 630 containing strongly adhered foreign matter 640.

Figure 7:
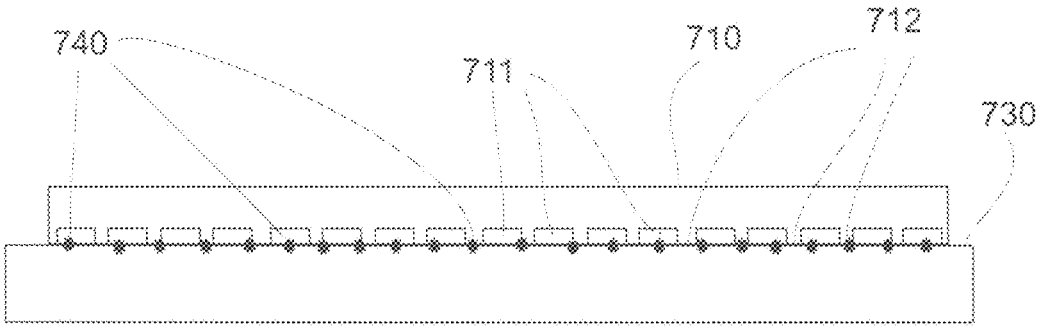
FIG. 7 is a side view of an illustrative elastically deformable compressible polishing material having functional repeating pattern of lowered reservoirs and raised plateaus being applied to a work surface having strongly adhered foreign matter such that the both the work surface and the strongly adhered foreign matter are in contact with the elastically deformable compressible polishing material having functional repeating pattern of lowered reservoirs and raised plateaus.

Turning now to FIG. 7, it shows a side view of an illustrative elastically deformable compressible polishing material 710 having functional repeating pattern of lowered reservoirs 711 and raised plateaus 712 being applied to a work surface 730 having strongly adhered foreign matter 740 such that the both the work surface 730 and the strongly adhered foreign matter 740 are in contact with the elastically deformable compressible polishing material 710 having functional repeating pattern of lowered reservoirs 711 and raised plateaus 712.

Figure 8A:
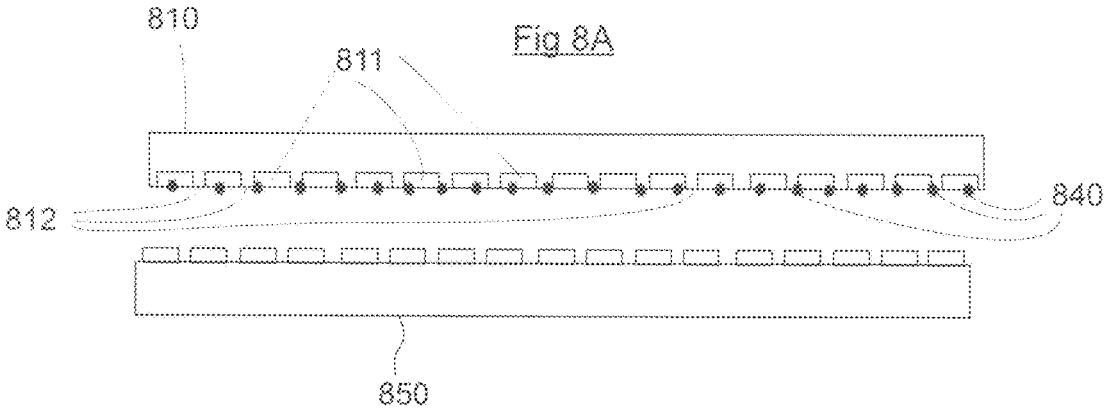
FIGS. 8A to 8C are side views of an illustrative elastically deformable compressible polishing material having functional pattern of lowered reservoirs and raised plateaus such that the raised plateaus have collected the strongly adhered foreign matter and the elastically deformable compressible polishing material having functional repeating pattern of lowered reservoirs and raised plateaus is contacted with a tool for forming new functional repeating pattern of lowered reservoirs and raised plateaus into the elastically deformable compressible polishing material, thereby forming at least a portion of clean raised plateaus on the elastically deformable compressible polishing material.

Now turning to FIG. 8A, it shows a side view of an illustrative elastically deformable compressible polishing material 810 having functional pattern of lowered reservoirs 811 and raised plateaus 812 such that the raised plateaus 812 have removed and collected strongly adhered foreign matter 840, the elastically deformable compressible polishing material 810 having functional pattern of lowered reservoirs 811 and raised plateaus 812 is in close proximity to the tool 850 for refreshing the functional repeating pattern of lowered reservoirs 811 and raised plateaus 812 in the elastically deformable polishing material.

Figure 8B:
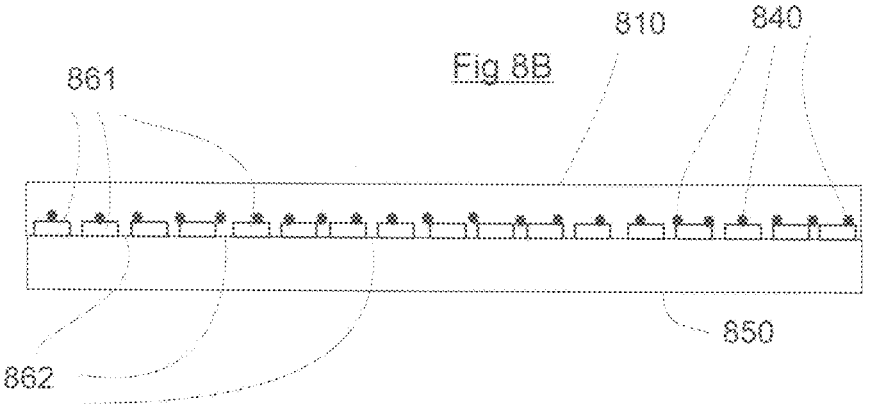

Turning now to FIG. 8B, it shows a side view of an illustrative elastically deformable compressible polishing material 810 in contact with a tool 850 for refreshing the functional repeating pattern of lowered reservoirs 861 and raised plateaus 862 into the elastically deformable polishing material 810, thereby forming at least a portion of a refreshed pattern of lowered reservoirs 861 and raised plateaus 862 on the elastically deformable compressible polishing material 810 where the refreshed raised plateaus 862 are substantially free of the collected strongly adhered foreign matter 840.

Figure 8C:
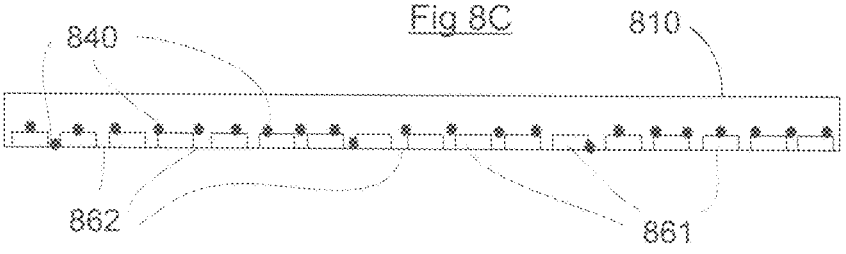

Now turning to FIG. 8C, it shows a side view of an illustrative elastically deformable compressible polishing material 810 that has a refreshed functional pattern of lowered reservoirs 861 and raised plateaus 862 on the elastically deformable compressible polishing material 810 where the where the refreshed raised plateaus 862 are substantially free of the collected strongly adhered foreign matter 840.

Figure 9:
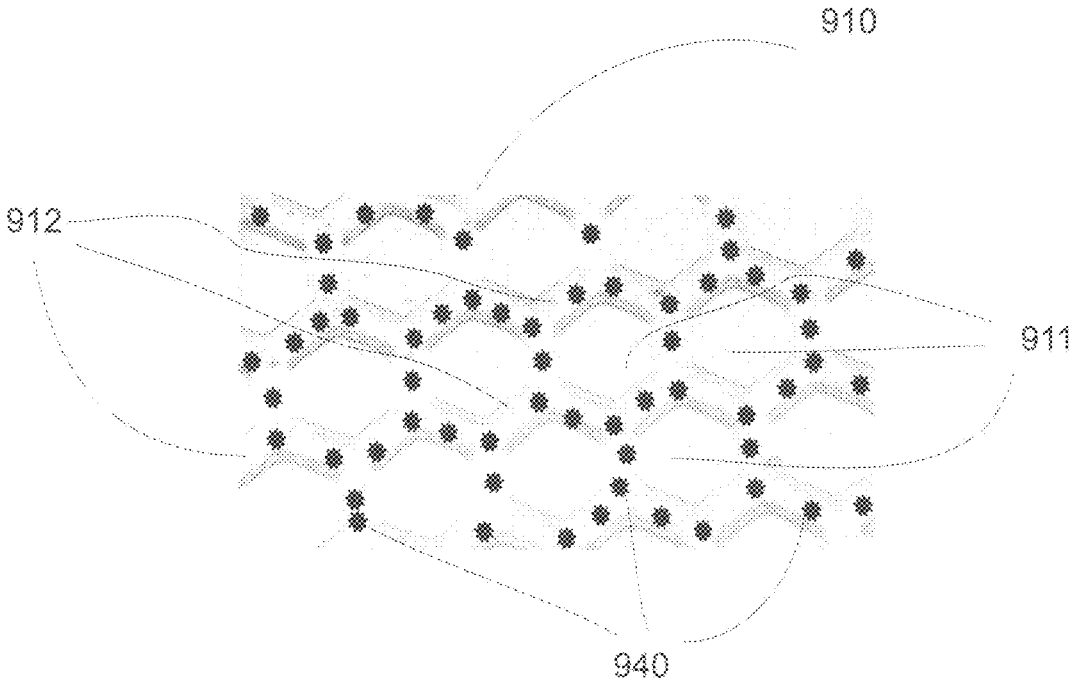
FIG. 9 is a perspective view of an illustrative elastically deformable compressible polishing material having functional repeating pattern of lowered reservoirs and raised plateaus to which the strongly adhered foreign matter has collected on the raised plateaus and not in the lowered reservoirs.

Turning now to FIG. 9, it shows a perspective view of an illustrative elastically deformable compressible polishing material 910 having functional repeating pattern of lowered reservoirs 911 and raised plateaus 912 to which the strongly adhered foreign matter 940 has collected on the raised plateaus 912 and not in the reservoirs 911.

Figure 10:
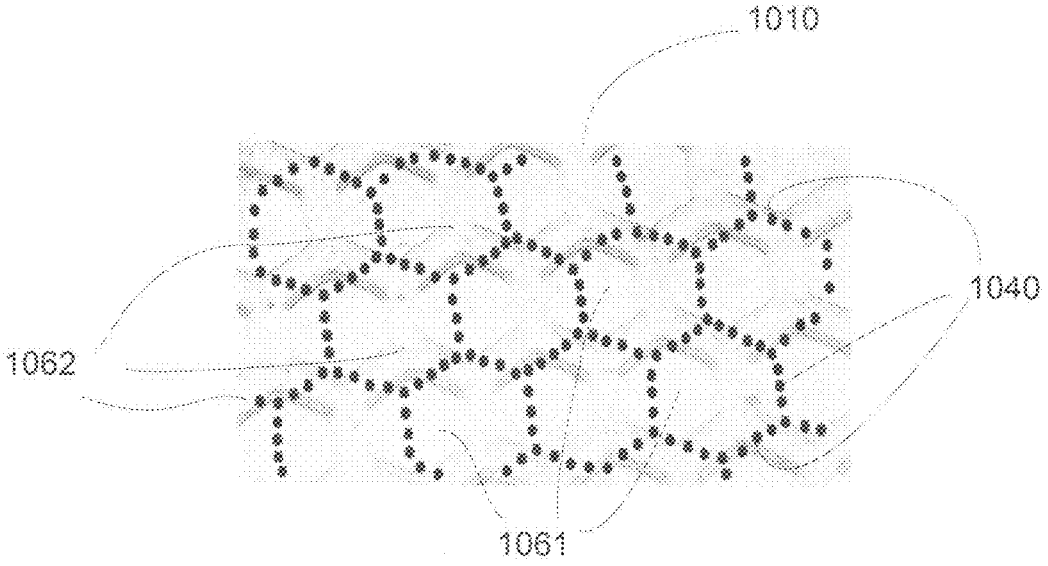
FIG. 10 is a perspective view of an illustrative elastically deformable compressible polishing material having functional repeating pattern of lowered reservoirs and raised plateaus where the raised plateaus collected the strongly adhered foreign matter and the functional repeating pattern of lowered reservoirs and raised plateaus are refreshed by creating a new functional repeating pattern of lowered reservoirs and raised plateaus such that the previously formed lowered reservoirs that were free of strongly adhered foreign matter are refreshed into raised plateaus.

Now turning to FIG. 10, it shows a perspective view of an illustrative elastically deformable compressible polishing material 1010 where strongly adhered foreign matter 1040 had been collected and the functional repeating pattern of lowered reservoirs 1061 and raised plateaus 1062 have been refreshed such that the refreshed plateaus 1062 are substantially free of strongly adhered foreign matter.

The foregoing is merely illustrative of the principles of this invention and various modifications can be made by those skilled in the art without departing from the scope and spirit of the invention.

What is claimed is:

1. A surface cleaning device comprising:

an elastically deformable compressible polishing material capable of having created on at least one surface a plurality of lowered reservoirs, each lowered reservoir having at least one side and at least one bottom, and a plurality of raised plateaus;

a tool having a plurality of raised areas for creating a portion of the plurality of lowered reservoirs, and a plurality of lowered areas for creating a portion of the plurality of raised plateaus, on the at least one surface of the elastically deformable compressible polishing material;

the tool placed into contact at with the at least one surface of the elastically deformable compressible polishing material; and a compressive force applied to the tool and the elastically deformable compressible polishing material to create the plurality of lowered reservoirs and the plurality of raised plateaus on the at least one surface of the elastically deformable compressible polishing material wherein the plurality of lowered reservoirs and the plurality of raised plateaus form a repeating pattern of shapes on the at least one surface of the elastically deformable compressible polishing material and wherein the plurality of raised plateaus are capable of collecting and removing strongly adhered foreign matter from a work surface while the plurality of lowered reservoirs are capable of remaining substantially free of strongly adhered foreign matter.

2. The surface cleaning device defined in claim 1 wherein the plurality of lowered reservoirs and the plurality of raised plateaus on the at least one surface of the elastically deformable compressible polishing material are created during manufacture of the elastically deformable compressible polishing material.

3. The surface cleaning device defined in claim 2 wherein the plurality of lowered reservoirs and the plurality of raised plateaus on the at least one surface of the elastically deformable compressible polishing material are refreshed by a user with the tool.

4. The surface cleaning device defined in claim 3 wherein the tool is on at least one surface a container capable of holding the elastically deformable compressible polishing material.

5. The surface cleaning device defined in claim 1 wherein the plurality of lowered reservoirs and the plurality of raised plateaus on the at least one surface of the elastically deformable compressible polishing material are created during packaging of the elastically deformable compressible polishing material.

6. The surface cleaning device defined in claim 5 wherein the plurality of lowered reservoirs and the plurality of raised plateaus on the at least one surface of the elastically deformable compressible polishing material are refreshed by a user with the tool.

7. The surface cleaning device defined in claim 6 wherein the tool is on at least one surface a container capable of holding the elastically deformable compressible polishing material.

8. The surface cleaning device defined in claim 1 wherein the plurality of lowered reservoirs and the plurality of raised plateaus on the at least one surface of the elastically deformable compressible polishing material are created by a user of the elastically deformable compressible polishing material.

9. The surface cleaning device defined in claim 8 wherein the plurality of lowered reservoirs and the plurality of raised plateaus on the at least one surface of the elastically deformable compressible polishing material are refreshed by the user with the tool.

10. The surface cleaning device defined in claim 9 wherein the tool is on at least one surface a container capable of holding the elastically deformable compressible polishing material.

11. The surface cleaning device defined in claim 1 wherein a portion of the plurality of lowered reservoirs are spaced apart approximately 1 millimeter from a center of a first lowered reservoir among the plurality of lowered reservoirs to a plurality of centers of the portion of the plurality of lowered reservoirs in close proximity to the first lowered reservoir.

12. The surface cleaning device defined in claim 1 wherein a portion of the plurality of lowered reservoirs are spaced apart approximately 6 millimeters from a center of a first lowered reservoir among the plurality of lowered reservoirs to a plurality of centers of the portion of the plurality of lowered reservoirs in close proximity to the first lowered reservoir.

13. The surface cleaning device defined in claim 1 wherein a portion of the plurality of lowered reservoirs are spaced apart between approximately 1 millimeters and 6 millimeters from a center of a first lowered reservoir among the plurality of lowered reservoirs to a plurality of centers of the portion of the plurality of lowered reservoirs in close proximity to the first lowered reservoir.

14. The surface cleaning device defined in claim 1 wherein said plurality of lowered reservoirs each having at least one side and at least one bottom further comprises the at least one side forming a right angle to the at least one bottom.

15. The surface cleaning device defined in claim 1 wherein said plurality of lowered reservoirs each having at least one side and at least one bottom further comprises the at least one side forming an obtuse angle to the at least one bottom.

16. The surface cleaning device defined in claim 1 wherein the plurality of lowered reservoirs each having at least one side and at least one bottom further comprises the at least one side being approximately 1 mm in height from the at least one bottom to adjacent portions of the plurality of raised plateaus in close proximity thereto.

17. The surface cleaning device defined in claim 15 wherein the plurality of lowered reservoirs each having at least one side and at least one bottom, the at least one side being approximately 1 mm in height from the at least one bottom to the adjacent portions of the plurality of raised plateaus in close proximity thereto, further comprises the adjacent portions of the plurality of raised plateaus in close proximity thereto being approximately 1 millimeter wide.

18. The surface cleaning device defined in claim 1 wherein a portion of the plurality of raised plateaus are spaced apart approximately 1 millimeter from a center of a first raised plateau among the plurality of raised plateaus to a plurality of centers of the portion of the plurality of raised plateaus in close proximity to the first raised plateau.

19. The surface cleaning device defined in claim 1 wherein a portion of the plurality of raised plateaus are spaced apart approximately 6 millimeters from a center of a first raised plateau among the plurality of raised plateaus to a plurality of centers of the portion of the plurality of raised plateaus in close proximity to the first raised plateau.

20. The surface cleaning device defined in claim 1 wherein a portion of the plurality of raised plateaus are spaced apart between approximately 1 millimeters and 6 millimeters from a center of a first raised plateau among the plurality of raised plateaus to a plurality of centers of the portion of the plurality of raised plateaus in close proximity to the first raised plateau.

21. The surface cleaning device defined in claim 1 wherein the elastically deformable compressible polishing material is removably affixed to an applicator.

22. The surface cleaning device defined in claim 21 wherein at least one surface of the applicator further comprises the tool.

23. The surface cleaning device defined in claim 22 further comprising:

a liquid lubricant being applied to the elastically deformable compressible polishing material having the plurality of lowered reservoirs and the plurality of raised plateaus on the at least one surface that is removably affixed to the applicator, or to the work surface, or to both;

the elastically deformable compressible polishing material having the plurality of lowered reservoirs and the plurality of raised plateaus on the at least one surface that is removably affixed to the applicator being placed in contact with the work surface;

a compressive force being applied to the elastically deformable compressible polishing material having the plurality of lowered reservoirs and the plurality of raised plateaus on the at least one surface that is removably affixed to the applicator;

the elastically deformable compressible polishing material having the plurality of lowered reservoirs and the plurality of raised plateaus on the at least one surface that is removably affixed to the applicator being moved across the work surface while in contact with the work surface to remove strongly adhered foreign matter from the work surface;

the elastically deformable compressible polishing material having the plurality of lowered reservoirs and the plurality of raised plateaus on the at least one surface that is removably affixed to the applicator being removed from the work surface;

visually inspecting the plurality of lowered reservoirs and the plurality of raised plateaus to determine whether a correct amount of compressive force was applied;

visually inspecting the plurality of lowered reservoirs and the plurality of raised plateaus to determine if strongly adhered foreign matter have been removed from the work surface and collected on the plurality of raised plateaus; and if an incorrect amount of compressive force was applied, or if strongly adhered foreign matter is found on the plurality of raised plateaus, or both, then refreshing the plurality of lowered reservoirs and the plurality of raised plateaus.

24. The surface cleaning device defined in claim 23 wherein the applicator is a human hand containing the tool.

25. The surface cleaning device defined in claim 23 wherein the applicator is a porous material containing the tool.

26. The surface cleaning device defined in claim 23 wherein the applicator is a non-porous material containing the tool.

27. The surface cleaning device defined in claim 1 further comprising:

a liquid lubricant being applied to the elastically deformable compressible polishing material having the plurality of lowered reservoirs and the plurality of raised plateaus on the at least one surface that is removably affixed to the applicator, or to the work surface, or to both;

the elastically deformable compressible polishing material having the plurality of lowered reservoirs and the plurality of raised plateaus on the at least one surface being placed in contact with the work surface;

the elastically deformable compressible polishing material having the plurality of lowered reservoirs and the plurality of raised plateaus on the at least one surface being moved across the work surface while in contact with the work surface to remove strongly adhered foreign matter from the work surface;

the elastically deformable compressible polishing material having the plurality of lowered reservoirs and the plurality of raised plateaus on the at least one surface being removed from the work surface;

visually inspecting the plurality of lowered reservoirs and the plurality of raised plateaus to determine if strongly adhered foreign matter have been removed from the work surface and collected on the plurality of raised plateaus; and if strongly adhered foreign matter is found on the plurality of raised plateaus, then refreshing the plurality of lowered reservoirs and the plurality of raised plateaus.

28. A surface cleaning device comprising:

an elastically deformable compressible polishing material capable of having created on at least one surface a plurality of lowered reservoirs, each lowered reservoir having at least one side and at least one bottom, and a plurality of raised plateaus;

a tool having a plurality of raised areas for creating a portion of the plurality of lowered reservoirs, and a plurality of lowered areas for creating a portion of the plurality of raised plateaus, on the at least one surface of the elastically deformable compressible polishing material;

the tool placed into contact at with the at least one surface of the elastically deformable compressible polishing material;

a compressive force being applied to the tool and the elastically deformable compressible polishing material to create the plurality of lowered reservoirs and the plurality of raised plateaus on the at least one surface of the elastically deformable compressible polishing material wherein the plurality of lowered reservoirs and the plurality of raised plateaus form a repeating pattern of shapes on the at least one surface of the elastically deformable compressible polishing material and wherein the raised plateaus are capable of removing and collecting strongly adhered foreign matter from a work surface while the lowered reservoirs remain substantially free of strongly adhered foreign matter;

a liquid lubricant being applied to the elastically deformable compressible polishing material having the plurality of lowered reservoirs and the plurality of raised plateaus on the at least one surface that is removably affixed to the tool, or to the work surface, or to both;

the elastically deformable compressible polishing material having the plurality of lowered reservoirs and the plurality of raised plateaus on the at least one surface being placed in contact with the work surface;

the elastically deformable compressible polishing material having the plurality of lowered reservoirs and the plurality of raised plateaus on the at least one surface being moved across the work surface while in contact with the work surface to remove strongly adhered foreign matter from the work surface;

the elastically deformable compressible polishing material having the plurality of lowered reservoirs and the plurality of raised plateaus on the at least one surface being removed from the work surface;

visually inspecting the plurality of lowered reservoirs and the plurality of raised plateaus to determine if strongly adhered foreign matter have been removed from the work surface and collected on the plurality of raised plateaus; and if strongly adhered foreign matter is found on the plurality of raised plateaus, then refreshing the plurality of lowered reservoirs and the plurality of raised plateaus.

29. A surface cleaning method comprising:

obtaining an elastically deformable compressible polishing means;

obtaining a means for creating a plurality of lowered reservoirs and a plurality of raised plateaus on at least one surface of the elastically deformable compressible polishing means;

placing the means for creating a plurality of lowered reservoirs and a plurality of raised plateaus into contact at with the at least one surface of the elastically deformable compressible polishing means;

applying a compressive force to the means for creating a plurality of lowered reservoirs and a plurality of raised plateaus and the elastically deformable compressible polishing means; and creating a repeating pattern of shapes on the at least one surface of the elastically deformable compressible polishing means wherein the plurality of raised plateaus are capable of removing and collecting strongly adhered foreign matter from a work surface while the plurality of lowered reservoirs are capable of remaining substantially free of strongly adhered foreign matter.

30. The surface cleaning method defined in claim 29 wherein creating the repeating pattern of shapes on the at least one surface of the elastically deformable compressible polishing means occurs during manufacturing of the elastically deformable compressible polishing means.

31. The surface cleaning method defined in claim 30 further comprising a user refreshing the plurality of lowered reservoirs and the plurality of raised plateaus on at least one surface of the elastically deformable compressible polishing means using the means for creating a plurality of lowered reservoirs and a plurality of raised plateaus on at least one surface of the elastically deformable compressible polishing means.

32. The surface cleaning method defined in claim 31 wherein means for creating a plurality of lowered reservoirs and a plurality of raised plateaus on at least one surface of the elastically deformable compressible polishing means comprises at least one surface a container capable of holding the elastically deformable compressible polishing means.

33. The surface cleaning method defined in claim 29 wherein creating the plurality of lowered reservoirs and the plurality of raised plateaus on the at least one surface of the elastically deformable compressible polishing means occurs during packaging of the elastically deformable compressible polishing means.

34. The surface cleaning method defined in claim 33 further comprising a user refreshing the plurality of lowered reservoirs and the plurality of raised plateaus on at least one surface of the elastically deformable compressible polishing means using the means for creating a plurality of lowered reservoirs and a plurality of raised plateaus on at least one surface of the elastically deformable compressible polishing means.

35. The surface cleaning method defined in claim 34 wherein the means for creating a plurality of lowered reservoirs and a plurality of raised plateaus on at least one surface of the elastically deformable compressible polishing means comprises at least one surface a container capable of holding the elastically deformable compressible polishing means.

36. The surface cleaning method defined in claim 29 wherein the plurality of Lowered reservoirs and the plurality of raised plateaus on the at least one surface of the elastically deformable compressible polishing material are created by a user using the means for creating the a plurality of lowered reservoirs and a plurality of raised plateaus on at least one surface of the elastically deformable compressible polishing means.

37. The surface cleaning method defined in claim 36 further comprising a user refreshing the plurality of lowered reservoirs and the plurality of raised plateaus on at least one surface of the elastically deformable compressible polishing means using the means for creating a plurality of lowered reservoirs and a plurality of raised plateaus on at least one surface of the elastically deformable compressible polishing means.

38. The surface cleaning method defined in claim 37 wherein the means for creating a plurality of lowered reservoirs and a plurality of raised plateaus on at least one surface of the elastically deformable compressible polishing means comprises at least one surface a container capable of holding the elastically deformable compressible polishing means.

39. The surface cleaning method defined in claim 29 further comprising removably affixing the surface cleaning means to an applicator means.

40. The surface cleaning method defined in claim 39 wherein at least one surface of the applicator means comprises the means for creating a plurality of lowered reservoirs and a plurality of raised plateaus on at least one surface of the elastically deformable compressible polishing means.

41. The surface cleaning method defined in claim 40 further comprising:

applying a liquid lubricant to the elastically deformable compressible polishing means having the plurality of lowered reservoirs and the plurality of raised plateaus on the at least one surface that is removably affixed to the applicator means, or to the work surface, or to both;

placing in contact with the work surface the elastically deformable compressible polishing means having the plurality of lowered reservoirs and the plurality of raised plateaus in the repeating pattern of shapes on the at least one surface that is removably affixed to the applicator means;

applying a compressive force to the elastically deformable compressible polishing means having the plurality of lowered reservoirs and the plurality of raised plateaus in the repeating pattern of shapes on the at least one surface that is removably affixed to the applicator means;

moving the elastically deformable compressible polishing means having the plurality of lowered reservoirs and the plurality of raised plateaus in the repeating pattern of shapes on the at least one surface that is removably affixed to the applicator means across the work surface while maintaining contact with the work surface thereby removing and collecting strongly adhered foreign matter from a work surface;

removing the elastically deformable compressible polishing means having the plurality of lowered reservoirs and the plurality of raised plateaus in the repeating pattern of shapes on the at least one surface that is removably affixed to the applicator means from the work surface;

inspecting the elastically deformable compressible polishing means having the plurality of lowered reservoirs and the plurality of raised plateaus in the repeating pattern of shapes on the at least one surface that is removably affixed to the applicator means;

determining if a correct amount of compressive force was applied;

determining if strongly adhered foreign matter have been removed from the work surface and collected on the plurality of raised plateaus on the at least one surface of the elastically deformable compressible polishing means and the plurality of lowered reservoirs have remained substantially free of strongly adhered foreign matter; and refreshing the elastically deformable compressible polishing means having the plurality of lowered reservoirs and the plurality of raised plateaus in the repeating pattern of shapes on the at least one surface if an incorrect amount of compressive force was applied or if strongly adhered foreign matter are found on the plurality of raised plateaus.

42. The surface cleaning method defined in claim 41 wherein the applicator means is a human hand containing the means for creating the plurality of lowered reservoirs and the plurality of raised plateaus on the at least one surface of the elastically deformable compressible polishing means.

43. The surface cleaning method defined in claim 41 wherein the applicator means is a porous material containing the means for creating the plurality of lowered reservoirs and the plurality of raised plateaus on the at least one surface of the elastically deformable compressible polishing means.

44. The surface cleaning method defined in claim 41 wherein the applicator means is a non-porous material containing the means for creating the plurality of lowered reservoirs and the plurality of raised plateaus on the at least one surface of the elastically deformable compressible polishing means.

45. The surface cleaning method defined in claim 29 further comprising:

applying a liquid lubricant to the elastically deformable compressible polishing means having the plurality of lowered reservoirs and the plurality of raised plateaus on the at least one surface that is removably affixed to the applicator means, or to the work surface, or to both;

placing in contact with a work surface the elastically deformable compressible polishing means having the plurality of lowered reservoirs and the plurality of raised plateaus in the repeating pattern of shapes on the at least one surface;

moving the elastically deformable compressible polishing means having the plurality of lowered reservoirs and the plurality of raised plateaus in the repeating pattern of shapes on the at least one surface across the work surface while maintaining contact with the work surface thereby removing and collecting strongly adhered foreign matter from the work surface;

removing the elastically deformable compressible polishing means having the plurality of lowered reservoirs and the plurality of raised plateaus in the repeating pattern of shapes on the at least one surface from the work surface;

inspecting the elastically deformable compressible polishing means having the plurality of lowered reservoirs and the plurality of raised plateaus in the repeating pattern of shapes on the at least one surface;

determining if strongly adhered foreign matter have been removed from the work surface and collected on the plurality of raised plateaus on the at least one surface of the elastically deformable compressible polishing means and the plurality of lowered reservoirs have remained substantially free of strongly adhered foreign matter; and refreshing the elastically deformable compressible polishing means having the plurality of lowered reservoirs and the plurality of raised plateaus in the repeating pattern of shapes on the at least one surface if strongly adhered foreign matter are found on the plurality of raised plateaus.

46. A surface cleaning method comprising:

obtaining an elastically deformable compressible polishing means;

obtaining a means for creating a plurality of lowered reservoirs and a plurality of raised plateaus on at least one surface of the elastically deformable compressible polishing means;

placing the means for creating a plurality of lowered reservoirs and a plurality of raised plateaus into contact at with the at least one surface of the elastically deformable compressible polishing means;

applying a compressive force to the means for creating a plurality of lowered reservoirs and the elastically deformable compressible polishing means;

creating a plurality of lowered reservoirs and a plurality of raised plateaus in a repeating pattern of shapes on the at least one surface of the elastically deformable compressible polishing means;

applying a liquid lubricant to the elastically deformable compressible polishing means having the plurality of lowered reservoirs and the plurality of raised plateaus on the at least one surface that is removably affixed to the applicator means, or to the work surface, or to both;

placing the elastically deformable compressible polishing means having the plurality of lowered reservoirs and the plurality of raised plateaus in the repeating pattern of shapes on the at least one surface in contact with the work surface;

moving the elastically deformable compressible polishing means having the plurality of lowered reservoirs and the plurality of raised plateaus in the repeating pattern of shapes on the at least one surface across the work surface while in contact with the work surface thereby removing and collecting strongly adhered foreign matter from a work surface;

removing the elastically deformable compressible polishing means having the plurality of lowered reservoirs and the plurality of raised plateaus in the repeating pattern of shapes on the at least one surface from the work surface;

inspecting the elastically deformable compressible polishing means having the plurality of lowered reservoirs and the plurality of raised plateaus in the repeating pattern of shapes on the at least one surface;

determining if strongly adhered foreign matter have collected on the plurality of raised plateaus on the at least one surface of the elastically deformable compressible polishing means while the plurality of lowered reservoirs have remained substantially free of strongly adhered foreign matter; and refreshing the elastically deformable compressible polishing means having the plurality of lowered reservoirs and the plurality of raised plateaus in the repeating pattern of shapes on the at least one surface if strongly adhered foreign matter are found on the plurality of raised plateaus.

* * * * *